US009200880B1

(12) United States Patent
Foren et al.

(10) Patent No.: US 9,200,880 B1
(45) Date of Patent: Dec. 1, 2015

(54) SUBSONIC AMMUNICATION ARTICLES HAVING A RIGID OUTER CASING OR RIGID INNER CORE AND METHODS FOR MAKING THE SAME

(71) Applicant: Carolina PCA, LLC, Cary, NC (US)

(72) Inventors: Wayne S. Foren, Cary, NC (US); David Jackson, Knightdale, NC (US); Gary Smith, Youngsville, NC (US)

(73) Assignee: Carolina PCA, LLC, Cary, NC (US)

( * ) Notice: Subject to any disclaimer, the term of this patent is extended or adjusted under 35 U.S.C. 154(b) by 0 days.

(21) Appl. No.: 13/841,607

(22) Filed: Mar. 15, 2013

Related U.S. Application Data

(63) Continuation-in-part of application No. 13/794,766, filed on Mar. 11, 2013, now Pat. No. 9,032,855.

(60) Provisional application No. 61/609,237, filed on Mar. 9, 2012.

(51) Int. Cl.
*F42B 33/00* (2006.01)
*F42B 33/02* (2006.01)
*F42B 33/04* (2006.01)

(52) U.S. Cl.
CPC ..... *F42B 33/02* (2013.01); *F42B 33/00* (2013.01); *F42B 33/04* (2013.01)

(58) Field of Classification Search
USPC ..... 86/19.5, 51, 55; 102/466, 467, 516, 517
See application file for complete search history.

(56) References Cited

U.S. PATENT DOCUMENTS

| | | | | |
|---|---|---|---|---|
| 3,694,529 | A | 9/1972 | Josephsen et al. | |
| 3,911,074 | A | 10/1975 | Kessler | |
| 4,157,684 | A | 6/1979 | Clausser | |
| 4,508,036 | A | 4/1985 | Jensen et al. | |
| 4,546,704 | A | 10/1985 | Ballreich et al. | |
| 4,809,612 | A | 3/1989 | Ballreich et al. | |
| 4,958,567 | A | 9/1990 | Olson et al. | |
| 5,176,839 | A | 1/1993 | Kim | |
| 5,259,288 | A | 11/1993 | Vatsvog | |
| 5,770,815 | A | 6/1998 | Watson et al. | |
| 5,822,904 | A | 10/1998 | Beal et al. | |
| 6,164,209 | A * | 12/2000 | Best et al. | 102/450 |
| 6,283,035 | B1 | 9/2001 | Olson et al. | |
| 6,752,084 | B1 | 6/2004 | Husseini et al. | |

(Continued)

OTHER PUBLICATIONS

Office Action for U.S. Appl. No. 13/794,766 dated Jun. 9, 2014.

(Continued)

*Primary Examiner* — Jonathan C Weber
(74) *Attorney, Agent, or Firm* — NK Patent Law, PLLC

(57) ABSTRACT

Two methods of making subsonic ammunition articles are provided that size the cavity to the propellant charge. The first method includes molding a core sleeve comprised of a unified neck, cavity sized to the propellant charge volume and a trailing end with an ejector ring, primer seat and flash hole; then, molding a polymer based casing over the core sleeve except the neck and a portion of the trailing end; then, inserting the primer, propellant charge and projectile; thereby, completing a subsonic ammunition article with a rigid core and a polymer casing. The second method includes injection molding a polymer sleeve within the casing of an ammunition article around a core pull positioned within the casing to form a thicker casing wall and a propellant cavity the volume of which corresponds to a desired propellant charge.

15 Claims, 38 Drawing Sheets

(56) References Cited

U.S. PATENT DOCUMENTS

| | | | | |
|---|---|---|---|---|
| 6,845,716 | B2 | 1/2005 | Husseini et al. | |
| 7,059,234 | B2 | 6/2006 | Husseini | |
| 7,213,519 | B2 * | 5/2007 | Wiley et al. | 102/467 |
| 7,441,504 | B2 | 10/2008 | Husseini et al. | |
| 7,610,858 | B2 | 11/2009 | Chung | |
| 7,921,780 | B2 * | 4/2011 | Harrison | 102/439 |
| 8,240,252 | B2 | 8/2012 | Maljkovic et al. | |
| 2001/0013299 | A1 | 8/2001 | Husseini et al. | |
| 2003/0131751 | A1 | 7/2003 | Mackerell | |
| 2005/0081704 | A1 | 4/2005 | Husseini | |
| 2005/0188883 | A1 | 9/2005 | Husseini et al. | |
| 2005/0257711 | A1 | 11/2005 | Husseini et al. | |
| 2005/0257712 | A1 | 11/2005 | Husseini et al. | |
| 2006/0011087 | A1 | 1/2006 | Husseini et al. | |
| 2006/0075919 | A1 * | 4/2006 | Wiley et al. | 102/464 |
| 2006/0230971 | A1 * | 10/2006 | Harrison | 102/374 |
| 2007/0044644 | A1 | 3/2007 | Husseini | |
| 2007/0214992 | A1 * | 9/2007 | Dittrich | 102/469 |
| 2009/0044717 | A1 | 2/2009 | Husseini et al. | |
| 2009/0178585 | A1 * | 7/2009 | Harrison | 102/380 |
| 2012/0111219 | A1 * | 5/2012 | Burrow | 102/467 |
| 2012/0180687 | A1 | 7/2012 | Padgett et al. | |
| 2014/0060373 | A1 | 3/2014 | Maljkovic et al. | |

OTHER PUBLICATIONS

Crane Using Lightweight .50 Cal Ammo, Sep. 13, 2011, http://kitup.military.com/2011/09/crane-using-lightweight-50-cal-ammo.html, last accessed Apr. 2, 2013.

Office Action dated Oct. 23, 2014 for U.S. Appl. No. 13/794,766, filed Mar. 11, 2013.

* cited by examiner

2010

2910

510

610

910

1210

1510

1510

1610

1710

2010

2010

2010

2310

2310

2610

2910

2910

2910

3210

3210

3210

SUBSONIC AMMUNICATION ARTICLES HAVING A RIGID OUTER CASING OR RIGID INNER CORE AND METHODS FOR MAKING THE SAME

CROSS-REFERENCE TO RELATED APPLICATIONS

This application is a continuation-in-part of U.S. patent application Ser. No. 13/794,766, filed on Mar. 11, 2013, which claims priority to U.S. Provisional Patent Application No. 61/609,237, filed on Mar. 9, 2012, the entire contents of which are hereby incorporated by reference.

TECHNICAL FIELD

This application is directed towards subsonic ammunition articles ("articles") and methods for making the same, and, more particularly, towards a polymer cased ammunition ("PCA") article or a rigid cased ammunition article having a propellant cavity ("cavity") sized and shaped by being molded around a core pull ("core pull") or a core sleeve that optimally corresponds to the desired propellant charge volume and shape ("propellant charge").

BACKGROUND

Ammunition articles typically are supersonic and generate an audible sound when the projectile travels at a speed greater than 1,100 feet per second during flight to the target ("supersonic articles"). This sound can be disadvantageous in military or covert operations because it may reveal the location where the supersonic article was discharged and ruin the element of surprise. Furthermore, noise can be an issue in law enforcement and commercial applications which needs to be abated.

Subsonic ammunition articles ("subsonic articles") have been developed that do not produce the distinguishable audible sound associated with supersonic articles. Such articles typically have less muzzle flash, use oversized projectiles, use less powder volume and function in traditional gas operated weapons. The propellant charge usually is a small charge loaded in a large cavity or gun powder with a filler. Using a reduced propellant charge without sizing the cavity to the propellant charge leaves a partially filled cavity resulting in inconsistent propellant distribution, prohibits uniform ignition and significantly alters the burn profile. The reduced propellant charge may create lower pressures which make consistent and complete case mouth obturation ("chamber sealing") difficult and makes it hard to get a clean burn of the propellant causing rapid fouling of the weapon. In some cases, subsonic articles do not produce sufficient port pressure to enable subsonic articles to cycle properly in gas operated weapons.

The PCA articles and associated methods for making the same set forth herein address the above referenced disadvantages associated with conventional subsonic articles and methods. PCA articles presented herein generally have a thermal polymer based material ("polymer") cartridge casing ("casing") that holds a projectile in the first end ("neck"), has a cavity and a base cap ("base cap") attached to the casing second end. A subsonic PCA article may contain a unified core that is molded around a core pull containing a base cap, cavity sleeve and a neck ("core sleeve" or "UCS").

It should be noted that articles contained herein are designed to function in existing weapons interchangeably with existing ammunition articles with functionality and performance improved over existing subsonic ammunition articles.

SUMMARY

This Summary is provided to introduce a selection of concepts in a simplified form that are further described below in the Detailed Description of Illustrative Embodiments. This Summary is not intended to identify key features or essential features of the claimed subject matter, nor is it intended to be used to limit the scope of the claimed subject matter.

Disclosed herein are two subsonic ammunition articles. The first article has a metal or composite material unified core sleeve with a neck, cavity volume that corresponds to the subsonic propellant charge volume and a trailing end including an ejector ring, primer base and flash hole. The core sleeve is inserted in a mold apparatus and a polymer based casing is molded around the core sleeve except for the neck and a portion of the trailing end. The primer is inserted in the primer cavity, propellant is inserted in the cavity and the projectile is inserted in the neck and affixed by crimping or another method completing a subsonic ammunition article with a core sleeve and a polymer outer casing. The second is a rigid case supersonic ammunition article converted to a subsonic ammunition article by injection molding a polymer sleeve around a core pull within the casing cavity increasing the cavity wall thickness and reducing the propellant cavity volume to correspond to the subsonic propellant charge volume. A primer is inserted in the primer cavity, propellant is inserted in the cavity and the projectile is inserted in the neck and affixed by crimping or another method completing a subsonic ammunition article with a metal core sleeve and a polymer outer casing. These subsonic ammunition articles are designed to function interchangeably in existing weapons systems. These articles are described in FIGS. 1C, 1D, 3*d*, 4 and 27 thru 32.

According to one or more embodiments, a method of making an ammunition article is provided. The method includes providing a projectile having at least one portion that defines a texturing, injection molding in a mold a material around a core pull and a portion of the projectile to form a casing, and removing the core pull to form a propellant charge cavity within the casing.

According to one or more embodiments, a trailing end of the projectile defines one of a boat tail or taper.

According to one or more embodiments, the casing defines a first end at which the projectile is molded around, and a second end, and the method further includes attaching a base cap to the second end.

According to one or more embodiments, injection molding a material comprises injection molding one of a thermal polymer, ceramic, metal, or a composite.

According to one or more embodiments, the material in the step of injection molding a material includes one of a plasticizer, lubricant, molding agent, filler, thermo-oxidative stabilizers, flame-retardants, coloring agents, compatibilizers, impact modifiers, release agents, and reinforcing fibers.

According to one or more embodiments, the method includes loading a propellant charge in the cavity.

According to one or more embodiments, loading a propellant charge in the cavity includes loading one of a gun powder or a composite of propellant materials that are substantially free of filler material and that occupy substantially all of the predetermined propellant charge volume.

According to one or more embodiments, the method includes preheating the projectile and molding into which the core pull is placed, and cycling heat in the mold including inductive heating.

According to one or more embodiments, injection molding around the core pull defines an area of increased thickness.

According to one or more embodiments, injection molding around the one of the boat tail or taper defines a seat against which the projectile abuts, and further wherein injection molding around the one of the boat tail or taper defines an area of increased thickness compared to a portion molded around a portion of the projectile that does not define one of a boat tail or taper.

According to one or more embodiments, the ammunition article is free of a neck portion about the projectile.

According to one or more embodiments, the mold defines one or more ribs and collars to thereby define corresponding ribs and collars on the casing after the step of injection molding in a mold.

According to one or more embodiments, the method includes inserting a sleeve into the propellant charge cavity to reduce the volume of the propellant charge cavity.

According to one or more embodiments, the method includes providing a base cap that is cold formed from metal or injection molded from polymer, ceramic, metal, or a composite material and into which a primer is inserted to ignite the propellant charge.

According to one or more embodiments, a method of making an ammunition article. The method determining a desired propellant charge volume for a given ammunition article, determining one or more dimensions of a casing such that a cavity defined therein has a volume that substantially corresponds to the desired propellant charge volume, and forming the casing having the one or more dimensions.

According to one or more embodiments, the ammunition article has one of a predetermined length and caliber.

According to one or more embodiments, the diameter of the cavity generally corresponds to the diameter of a trailing end of the projectile.

According to one or more embodiments, the one or more dimensions includes at least one of an interior diameter and length of the cavity, and a cross-section of the casing.

According to one or more embodiments, a method of making a subsonic ammunition article is provided. The method includes providing a sleeve having a cavity and that is positioned proximal a projectile and injection molding, in a mold, a material around the sleeve to form a casing.

According to one or more embodiments, the sleeve is molded at one station and the polymer based casing is molded around the sleeve in a mold at a second station.

According to one or more embodiments, a primer is inserted in a primer seat at a trailing end of the casing, a propellant charge is loaded in the cavity through a neck of the ammunition article, and inserting the projectile into the neck.

BRIEF DESCRIPTION OF THE DRAWINGS

The foregoing summary, as well as the following detailed description of preferred embodiments, is better understood when read in conjunction with the appended drawings. For the purposes of illustration, there is shown in the drawings exemplary embodiments; however, the presently disclosed invention is not limited to the specific methods and instrumentalities disclosed. In the drawings:

FIG. 3B depicts components of a subsonic PCA article with casing external ribs and a FIG. 6 projectile according to one or more embodiments disclosed herein;

DETAILED DESCRIPTION

The presently disclosed invention is described with specificity to meet statutory requirements. However, the description itself is not intended to limit the scope of this patent; rather, the inventor(s) have contemplated that the claimed invention might also be embodied in other ways, to include different elements similar to the ones described in this document, in conjunction with other present or future technologies. Moreover, although the term "step" may be used herein to connote different aspects of methods employed, the term should not be interpreted as implying any particular order among or between various steps herein disclosed unless and except when the order of individual steps is explicitly described.

Figure 1A:
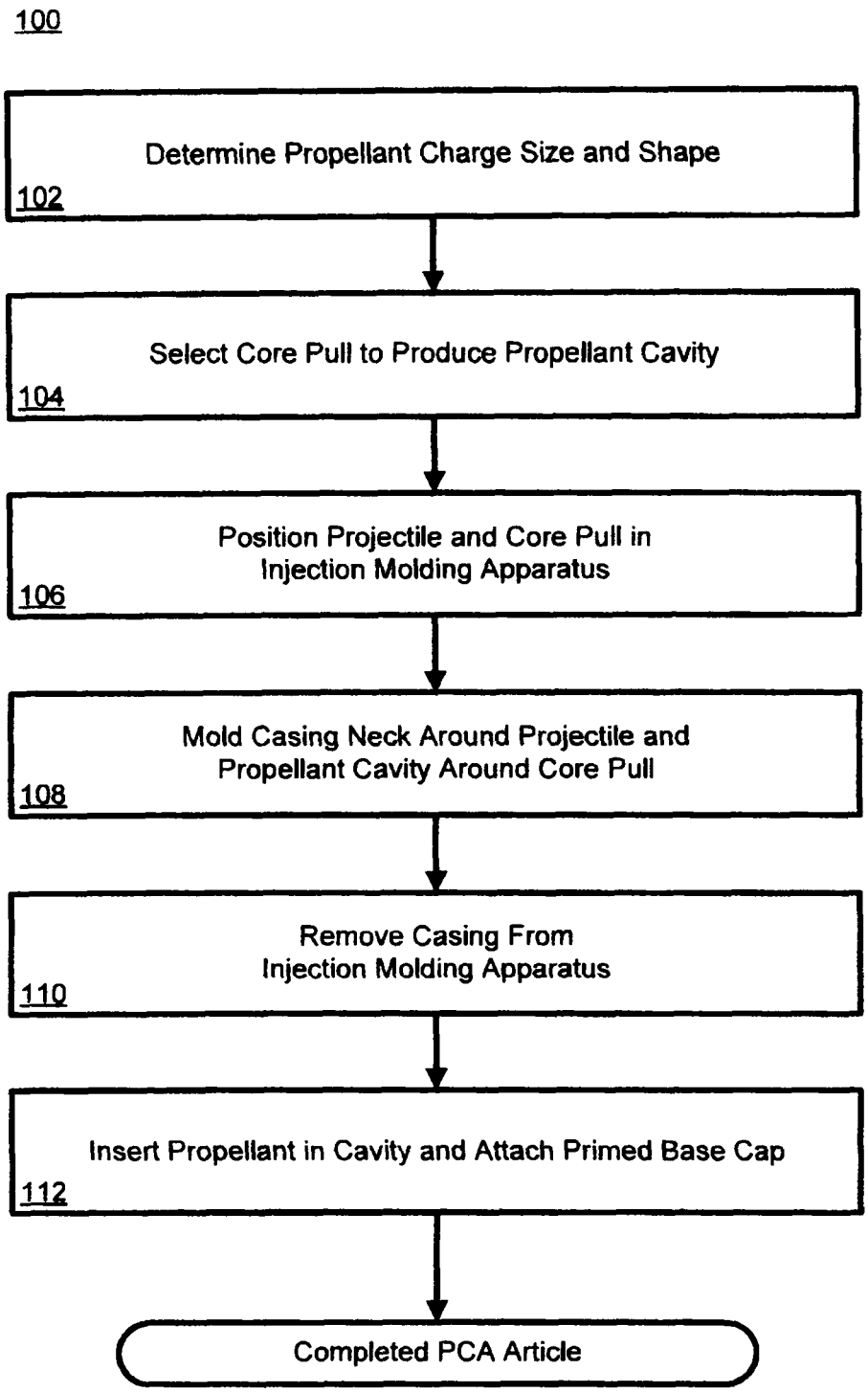
FIGS. 1A, 1B, 1C, and 1D are flow charts depicting one or more methods for making an article according to one or more embodiments disclosed herein.

Provided herein are one or more methods for making an article and associated articles. FIG. 1A illustrates one or more methods 100 for making supersonic or subsonic PCA articles. The one or more methods 100 may be applicable for any size and style article for small arms. The one or more methods 100 are particularly advantageous for manufacturing subsonic articles. The one or more methods 100 include several steps beginning with 102, which includes determining the propellant charge composition, volume and shape needed to achieve the ballistics required for a given PCA article. Step 104 of method 100 includes selecting a core pull that will produce a cavity corresponding to the propellant volume and shape required. Step 106 of method 100 includes inserting the projectile in a mold and seating the core pull in the mold against the base of the projectile. Step 108 of method 100 includes injecting polymer through a gate in the mold cavity and around the core pull and the projectile trailing end, thereby creating a casing molded around a portion of the projectile and having a cavity sized and shaped to receive the required propellant charge when the core pull is removed. If one desires an article having a smaller cavity to accommodate a reduced propellant charge volume, a smaller core pull would be selected. For example, if one desires a cavity with a 5 millimeter inner diameter instead of a 9.5 millimeter inner diameter, a core pull having a 5 millimeter diameter would be selected. In this manner, the mold cavity and core pull define the cavity wall thickness. Step 110 of method 100 includes removing the core pull and casing from the mold. Step 112 of method 100 includes loading the propellant charge in the cavity which may be gun powder or other appropriately configured materials that are substantially free of a filler material. In this manner, the propellant charge can be of high quality material for improved ignition characteristics and the propellant charge will occupy substantially all of the cavity volume. As used herein, "substantially all" means a cavity volume in which any unfilled space in the cavity after the propellant charge has been loaded is small in portion. Finally, step 114 of method 100 includes attaching a primed base cap to the second end of the casing which completes the PCA article.

Figure 1B:
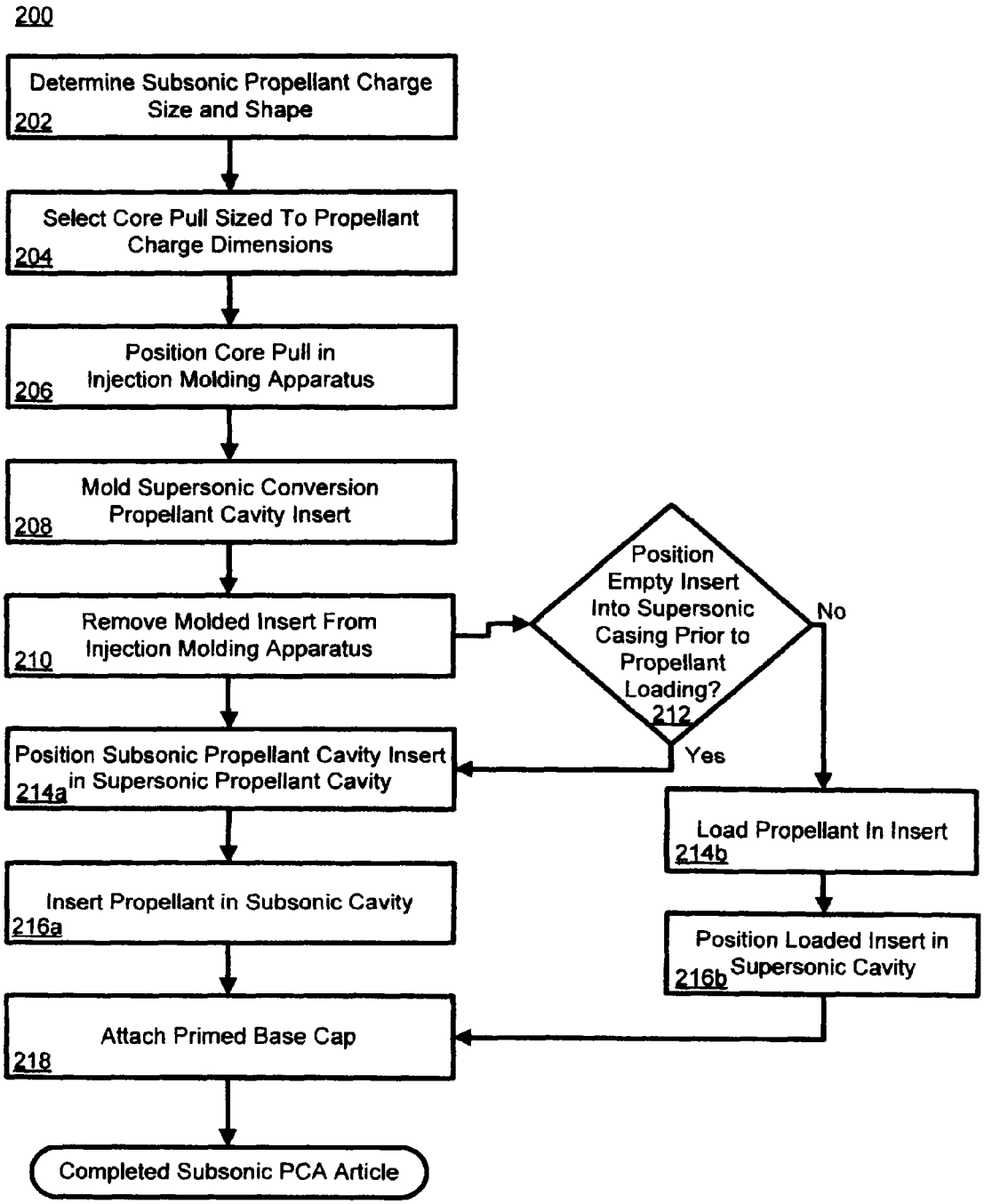

FIG. 1B illustrates one or more methods 200 of converting a supersonic PCA casing to a subsonic article. The one or more methods 200 include converting a supersonic PCA casing made pursuant to one or more methods 100 contained in FIG. 1 to a subsonic PCA casing by inserting a sleeve in the supersonic PCA cavity; thereby, converting the cavity from supersonic to subsonic. The sleeve, whether injected molded or otherwise formed, will reduce the cavity to the desired volume and shape once inserted. Like step 102 of method 100, step 202 of method 200 includes determining the desired propellant charge volume and shape taking into consideration the type of ammunition powder or charge, the size and weight of a projectile, and other factors. Like step 104 of method 100, step 204 of method 200 includes determining the cavity dimensions that correspond to the desired propellant charge volume and shape and selecting a core pull that will produce such dimensions. For example, if a subsonic article is desired whereby the projectile muzzle velocity is less than 1,100 feet per second (340 meters per second), the cavity dimensions can be selected to match the propellant charge volume and shape needed to achieve the desired performance characteristics. In one or more embodiments, the cavity sidewall may be uniform throughout any given cross-section of the cavity, whereas, in one or more additional embodiments, the cavity may not be uniform and may instead take on any optimally configured or desired cross-section. For example, the cavity sidewall may include a plurality of stepped-up and stepped-down portions or other desired configuration. Like steps 106 through 110 of method 100, steps 206 through 210 of method 200 include one or more methods of positioning the core pull in a mold designed to produce the cavity insert, forming the insert by injecting molding polymer around the core pull and removing the cavity insert from the mold. Step 212 includes one or more methods of positioning the cavity insert in the method 100 PCA cavity. Like step 112 of method 100, steps 214 and 216 of method 200 include inserting propellant charge in the cavity insert and attaching a primed base cap to the second end of the casing; thereby, completing the method 200 PCA subsonic article. As an alternative, the propellant charge may be loaded before the cavity sleeve is loaded in the casing with a combustible membrane securing the propellant at each end.

Figure 1C:
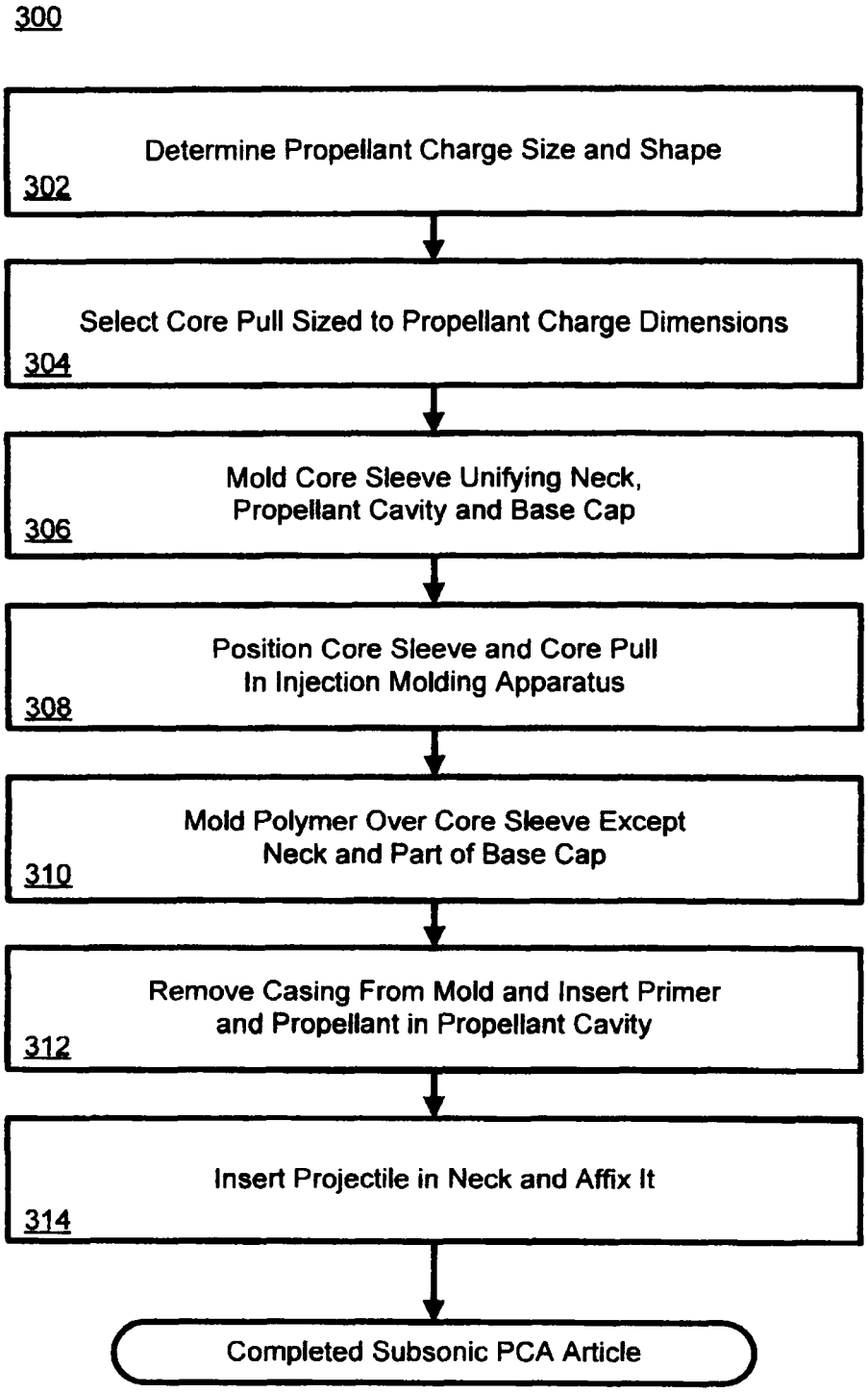

FIG. 1C illustrates one or more methods 300 of making a subsonic PCA article with a core sleeve. The one or more methods 300 include a metal core sleeve whether injection molded or cold formed and molding a polymer casing around the cavity area thereof. Step 302 of method 300 includes determining the subsonic propellant charge, volume and shape needed. Step 304 of method 300 includes determining the subsonic cavity dimensions required to accommodate the propellant charge needed and select a core pull sized to produce such dimensions. Step 306 of method 300 includes molding a core sleeve. Step 308 of method 300 includes inserting the sleeve in a mold and securing it in place. Step 310 of method 300 includes injecting polymer through a gate in the mold around the core sleeve forming the casing. Step 312 of method 300 includes removing the casing from the mold, inserting a primer in the primer cavity located in the casing second end and loading the propellant charge in the cavity through the neck. Step 314 of method 300 includes inserting the projectile in the first end affixed by crimping, gluing or another method; thereby, completing the subsonic PCA article with a core sleeve.

Figure 1D:
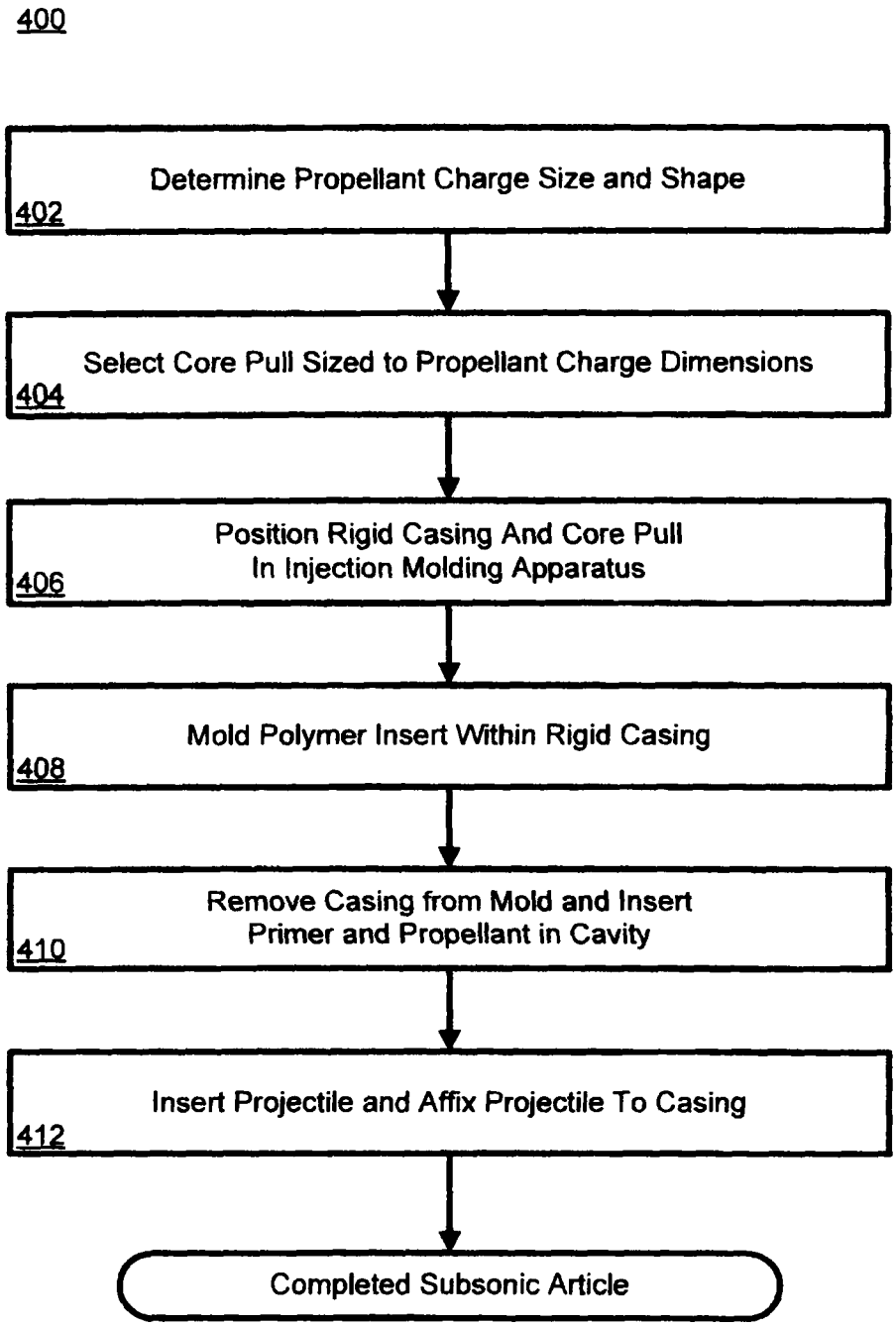

FIG. 1D illustrates one or more methods 400 of converting a rigid supersonic casing to a subsonic article. The one or more methods 400 begin with determining the propellant charge needed for a specific ammunition article including volume and shape. Step 404 includes selecting a core pull that is sized and shaped to create the cavity to the desired propellant size and shape. Step 406 involves inserting the rigid casing in a molding apparatus with the core pull selected in step 404 inserted in the casing through the neck. Also, a secondary core pull is inserted in the primer seat that extends into the flash hole and is seated against the core pull inserted through the neck. This secondary core pull may also serve as a gate for injecting polymer into the mold cavity which is the area between the primary core pull and the casing wall. Step 408 includes closing the mold and injecting polymer around the core pull. In Step 410, the subsonic rigid casing with a polymer sleeve is removed from the mold when it opens and the core pull is retracted. In step 412, the rigid cased subsonic article is assembled: the primer is inserted, propellant loaded in the cavity; and the projectile is inserted and crimped or otherwise affixed to the casing.

Figure 2:
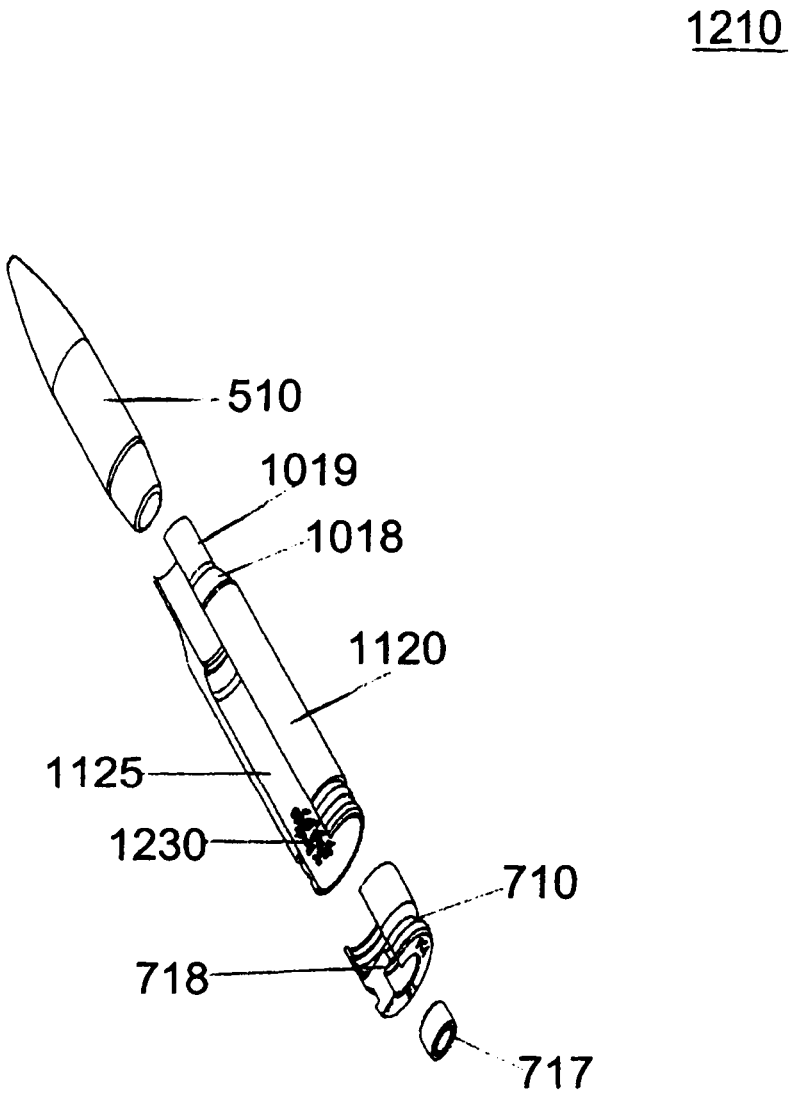
FIG. 2 depicts components of a supersonic PCA article with a FIG. 5 projectile according to one or more embodiments disclosed herein.

FIG. 2 illustrates supersonic PCA article 1210 components. Casing 1120 is a structural supersonic component with a first end into which the projectile 510 is seated and cavity 1125 into which the propellant charge is loaded and to which a primed base cap 710 is attached; thereby, completing the PCA. PCA casings must have the ability to deform under high ballistic pressures ("ductility") and maintain reliable case integrity under extreme temperatures (−45 to 165 degrees Fahrenheit) without cracking or splitting.

Figure 3A:
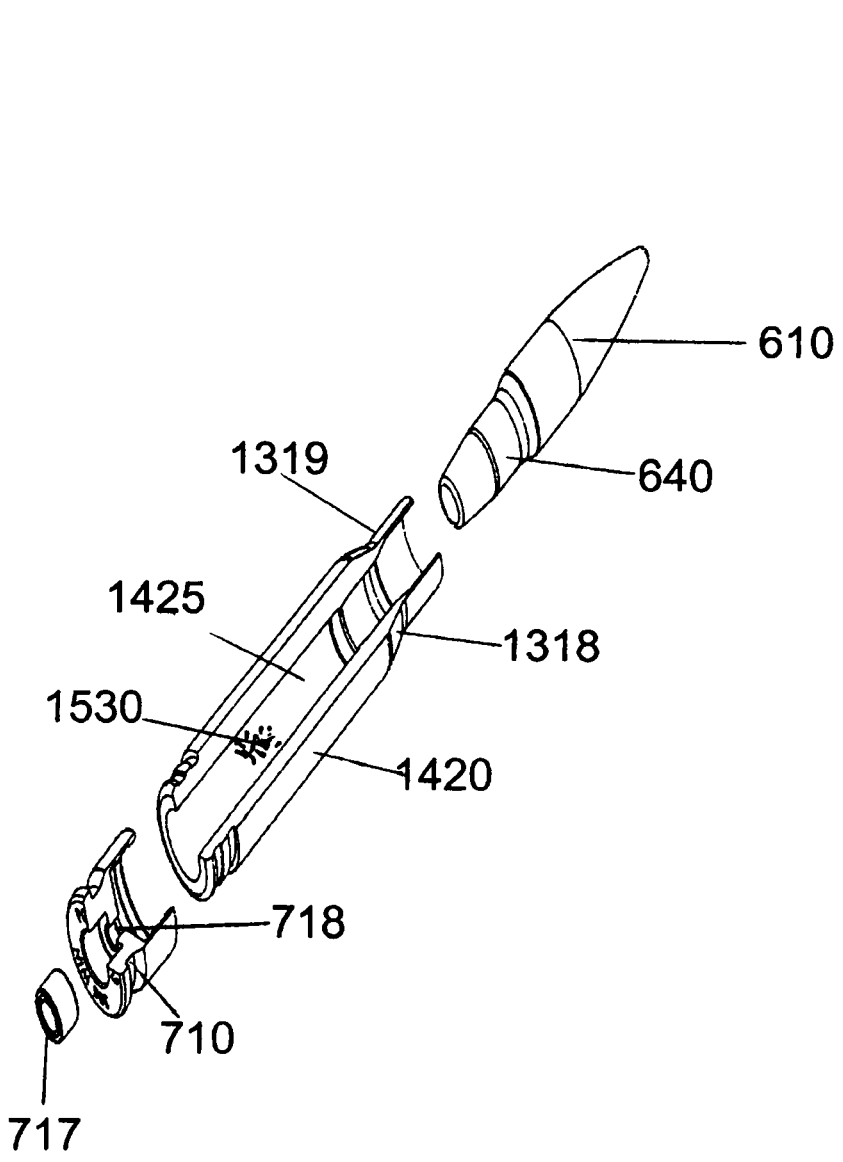
FIG. 3A depicts components of a subsonic PCA article with a FIG. 6 projectile according to one or more embodiments disclosed herein.
Figure 38:
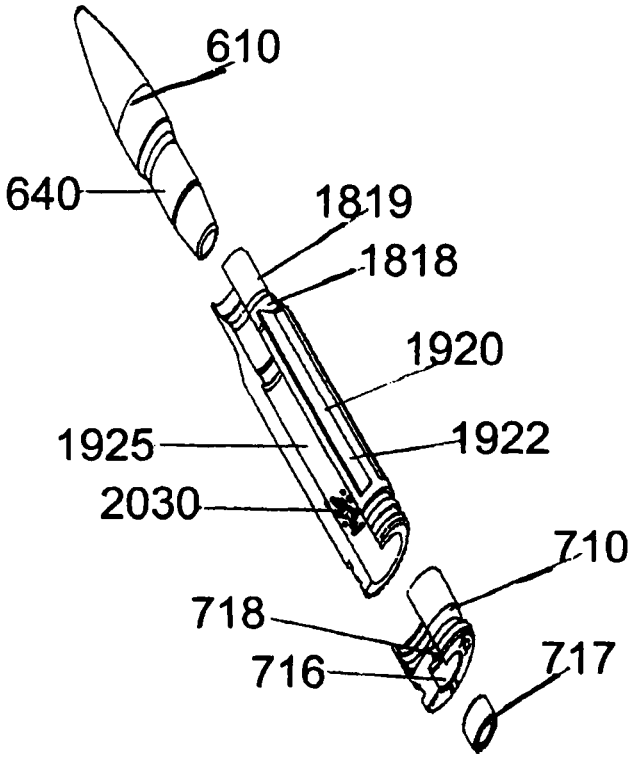

FIG. 3A illustrates subsonic PCA article 1510 components which are similar to FIG. 2 components except that casing 1420 is thicker and the cavity has a smaller diameter than FIG. 2 and projectile 610 used herein has a tapered trailing end.

FIG. 3B illustrates subsonic PCA article 2010 components which are similar to FIG. 3*a* components except that casing 1920 has external ribs.

Figure 3C:
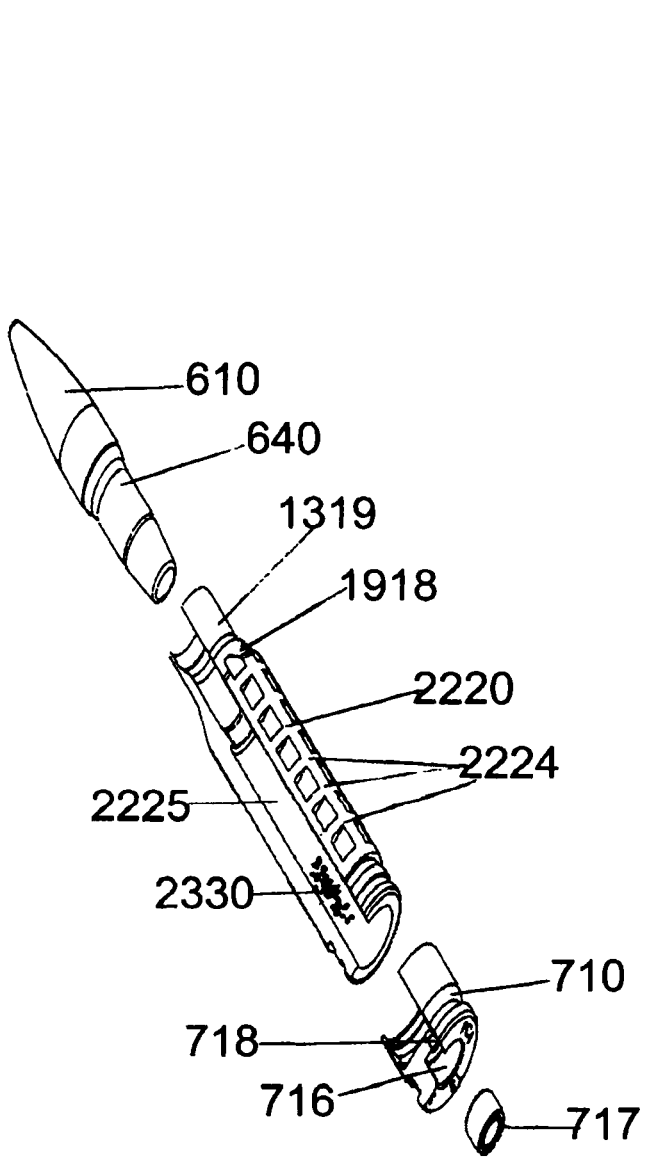
FIG. 3C depicts FIG. 3B with external ribs and collars around the casing according to one or more embodiments disclosed herein.

FIG. 3C illustrates subsonic PCA article 2310 which is article 2010 with external collars around the casing as well as external ribs.

Figure 3D:
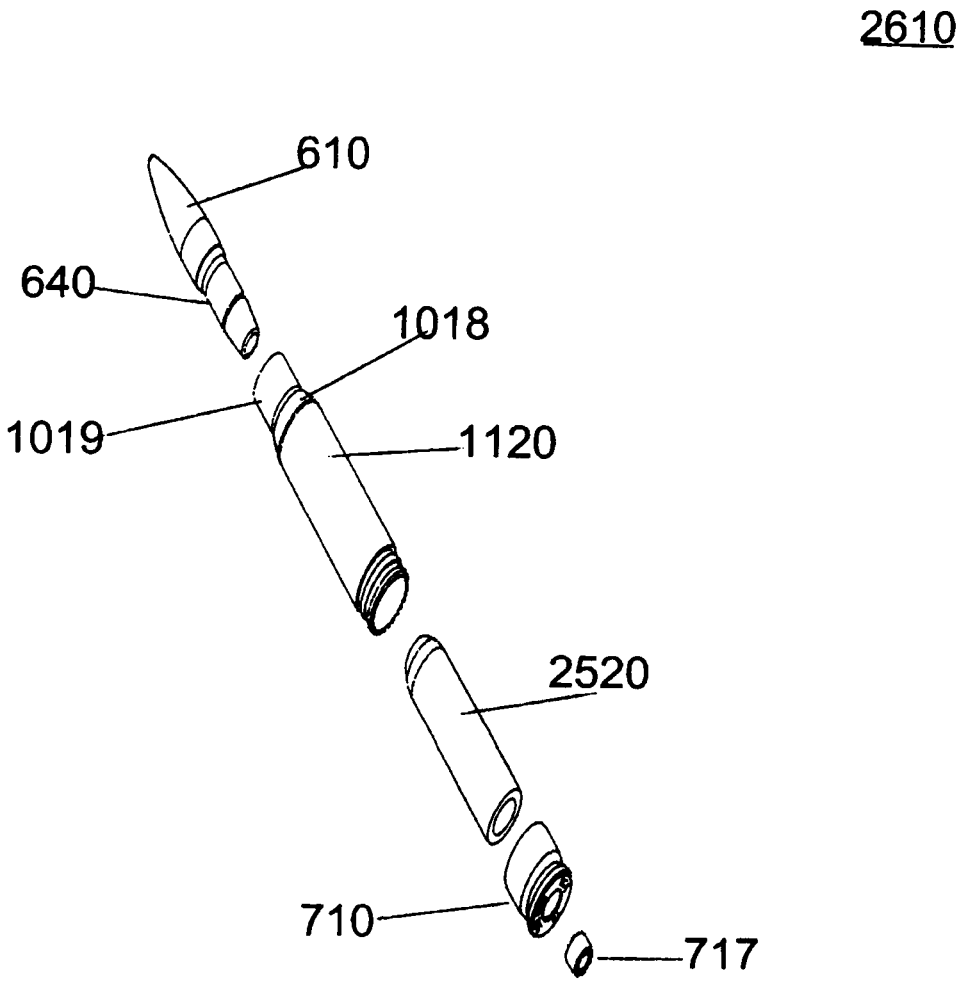
FIG. 3D depicts components of a supersonic PCA article converted to a subsonic PCA article according to one or more embodiments disclosed herein.

FIG. 3D illustrates subsonic article 2610 components which include a supersonic PCA casing 1120 converted to a subsonic PCA casing 2320 by placing cavity insert 2320 in cavity 1120, loading the propellant charge therein and attaching a primed base cap to the casing second end. The cavity insert is capable of being loaded with propellant charge before being loaded into the 1120 PCA casing.

Figure 4:
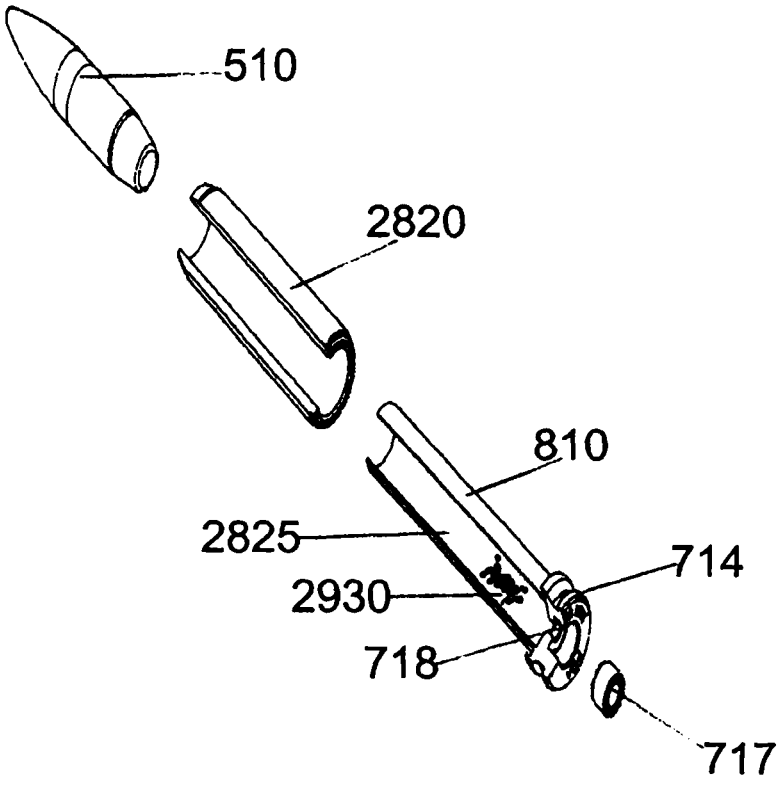
FIG. 4 depicts components of a subsonic PCA article with a core sleeve according to one or more embodiments disclosed herein.

FIG. 4 illustrates subsonic PCA article 2710 components which includes a polymer casing molded around a core sleeve, a primer 717 inserted in the primer cavity at the casing trailing end and projectile 510 or 610 inserted in the neck after the propellant charge is loaded through the neck.

Figure 5:
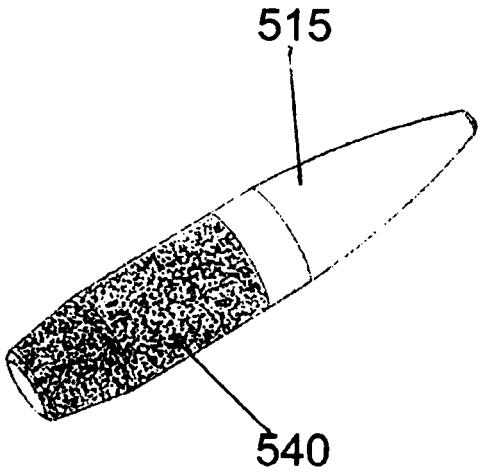
FIG. 5 depicts a .308 Cal. full metal jacket boat tail projectile according to one or more embodiments disclosed herein.
Figure 6:
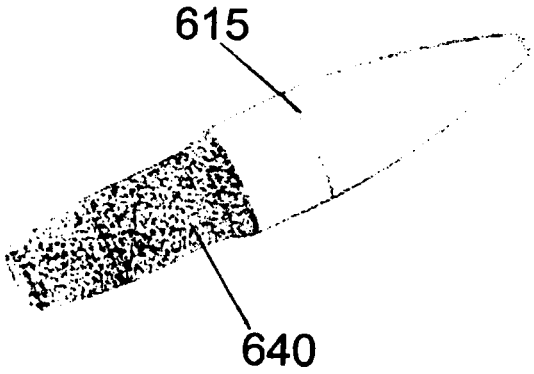
FIG. 6 depicts a projectile according to FIG. 5 with a tapered trailing end ("projectile tapered trailing end" or "PTTE") according to one or more embodiments disclosed herein.

FIG. 5 illustrates a projectile 510 that is attached to the first end of a casing by one of several methods. As illustrated herein, the first end of the casing is overmolded around the projectile trailing end. Although various size projectiles may be used in supersonic PCA articles, FIG. 5 depicts a .308 cal 220 grain full metal jacket boat-tail projectile. Unless the projectile trailing end is tapered as depicted in FIG. 6, a boat-tail projectile may be beneficial for use in PCA articles because the casing area molded around the projectile trailing end creates a seat ("projectile seat") that prevents the projectile from compressing into the cavity. The projectile trailing end is textured except for the neck area as a method of creating appropriate neck tension when a casing is overmolded about the projectile trailing 640. Greater tension requires heavier texturing and less tension requires finer texturing. The neck area remains untextured to reduce stress on the neck/shoulder joint. Overmolding a projectile with canneluring creates a die-lock condition because polymer fills the canneluring groove during the overmolding process which causes neck failure when the PCA article is fired. A secondary benefit of texturing the projectile trailing end 640 may be greater stability in flight which may be magnified if the entire projectile is textured. The length of the overmolded textiled trailing end in the shoulder and cavity may render the neck unnecessary to hold the projectile and provide necessary pull tension. Furthermore, head space is determined by the shoulder and not the neck for rifle ammunition articles. Reducing or eliminating the casing neck will reduce or eliminate instances of neck failure in PCA articles.

FIG. 6 illustrates projectile 610 which is FIG. 5 with a tapered trailing end to provide improved strength in the casing neck and neck/shoulder joint with about 2 millimeters of the projectile trailing end at the mouth of the casing unchanged and overmolded.

Figure 7:
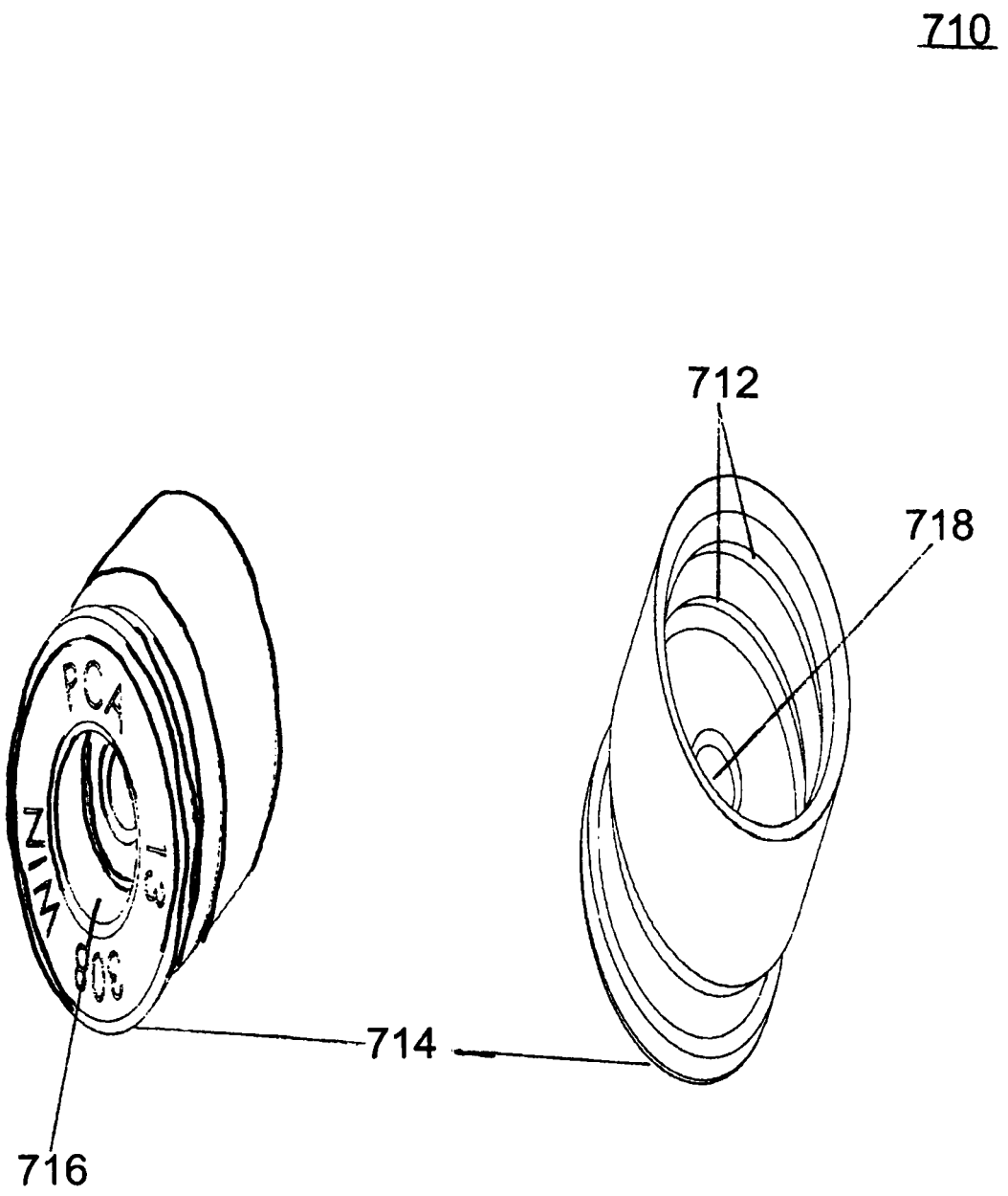
FIG. 7 depicts a cold formed or molded base cap according to one or more embodiments disclosed herein.

FIG. 7 Illustrates base cap 710 that is attached to the second end of a casing. The one or more methods may also include cold forming or injection molding the base cap from polymer, metal or a composite material. The base cap has a first end with internal grooves 712 matching the ridges on the exterior of the casing trailing end and an exterior ejector ring 714 at the trailing end for extraction purposes. The bottom of the base cap has a primer cavity 716 into which a primer 717 is seated and a flash-hole 718 through which the propellant charge is ignited when the primer is activated.

Figure 8:
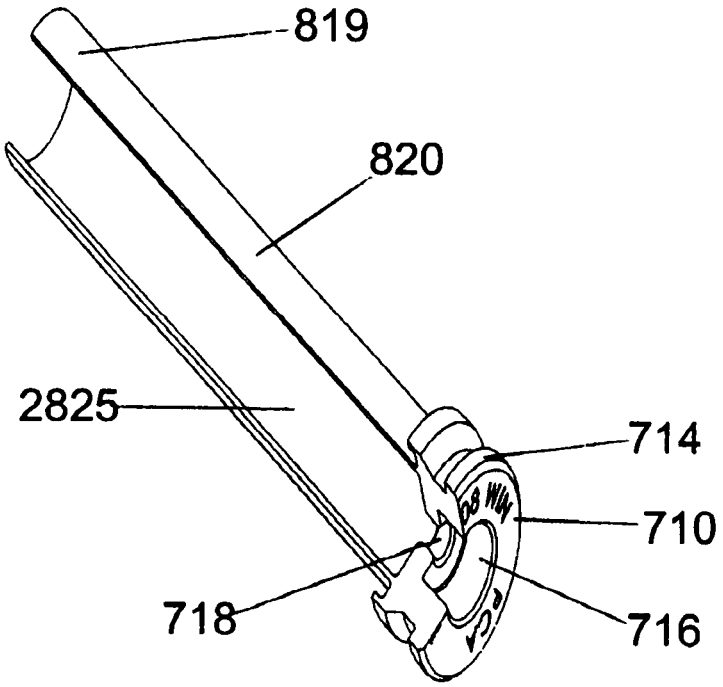
FIG. 8 depicts an injected molded core sleeve according to one or more embodiments disclosed herein.

FIG. 8 illustrates a molded core sleeve including a FIG. 7 base cap without grooves that is seamlessly attached to a cavity sleeve 820 and neck 819. The neck may be short as in the case of FIG. 16. The core sleeve may have several rings evenly spaced along the cavity sleeve which may also be textured. The base may have a ledge which together with the rings and texturing will prevent the polymer casing from sliding on the core sleeve or separating upon ejection. The cavity section of the sleeve is shaped and sized to match the propellant charge and the casing first end is shaped to receive a FIG. 5 or 6 projectile which may or may not be textured.

Figure 9:
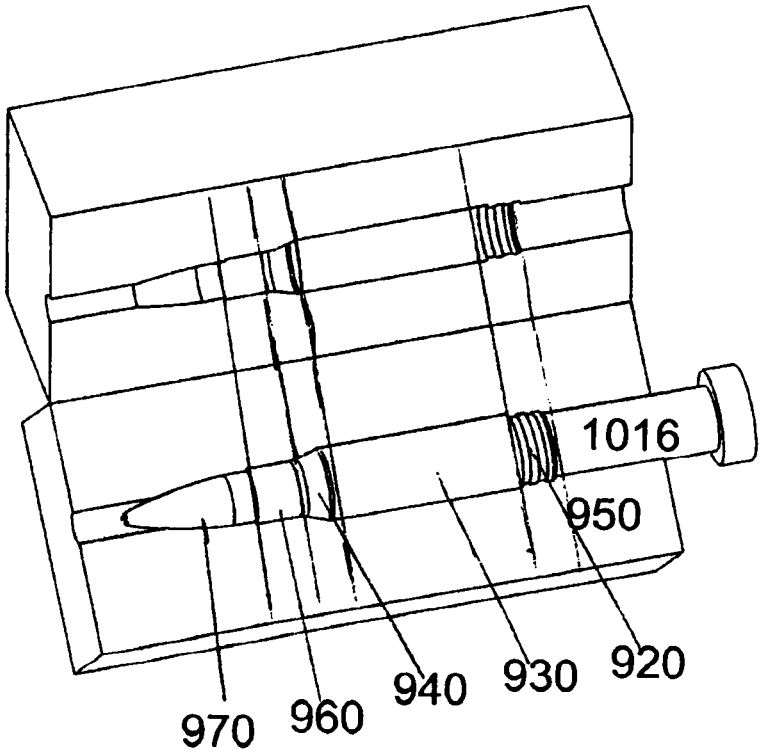
FIG. 9 depicts a mold apparatus for molding a polymer casing that is segmented for heat cycling according to one or more embodiments disclosed herein.

FIG. 9 illustrates a universal mold 950 for producing PCA casings and is divided into several sections, e.g., the neck area 960, shoulder area 940, cavity area 930 and the base cap connection area 920. The molding temperature needs to be higher in the areas where the casing wall is the thinnest and lower where the casing wall is the thickest; therefore, the molding temperature at the neck needs to be the highest, the shoulder molding temperature needs to be the lowest and the cavity molding temperature needs to be moderately high. The mold needs to be segmented into several heat zones to accommodate the differing temperature requirements ("heat cycling") of polymer as it enters the mold through a gate in the cavity at the casing trailing end and moves around the core pull and the projectile trailing forward to the mouth of the neck which is the thinnest casing wall. About five percent (5%) of the casing outer layer where the material enters the mold ("shear layer") has little strength and radiates through the casing length. For example, a subsonic shear layer of 5% at the cavity is 22% of the neck wall unless a projectile tapered projectile is used. Heating the projectile to prevent it from becoming a heat-sink and prematurely cooling the polymer is essential to avoid neck failure. Finally, intensive heating may be required to achieve proper temperature in the mold segments which strengthens casing wall.

Figure 10:
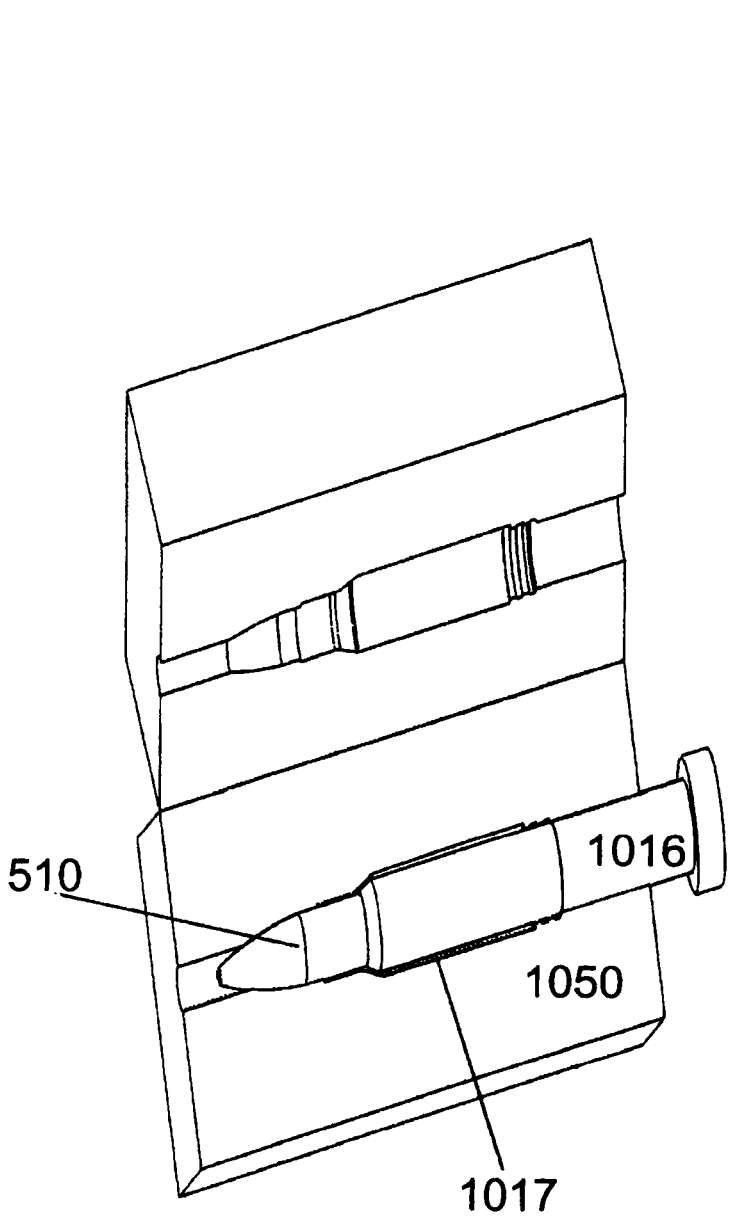
FIG. 10 depicts a FIG. 5 projectile and a core pull inserted in a mold for making a supersonic casing according to one or more embodiments disclosed herein.
Figure 11:
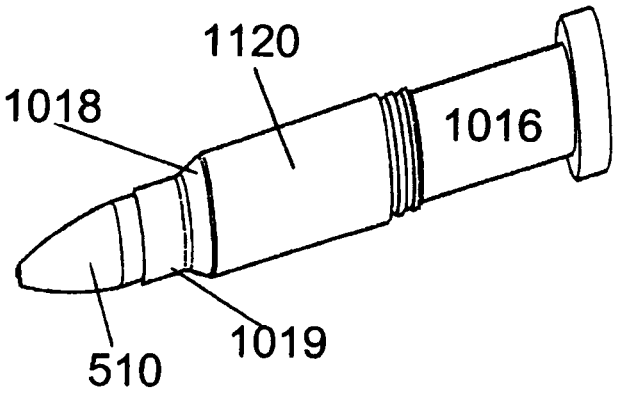
FIG. 11 depicts a casing made in FIG. 10 according to one or more embodiments disclosed herein.
Figure 12:
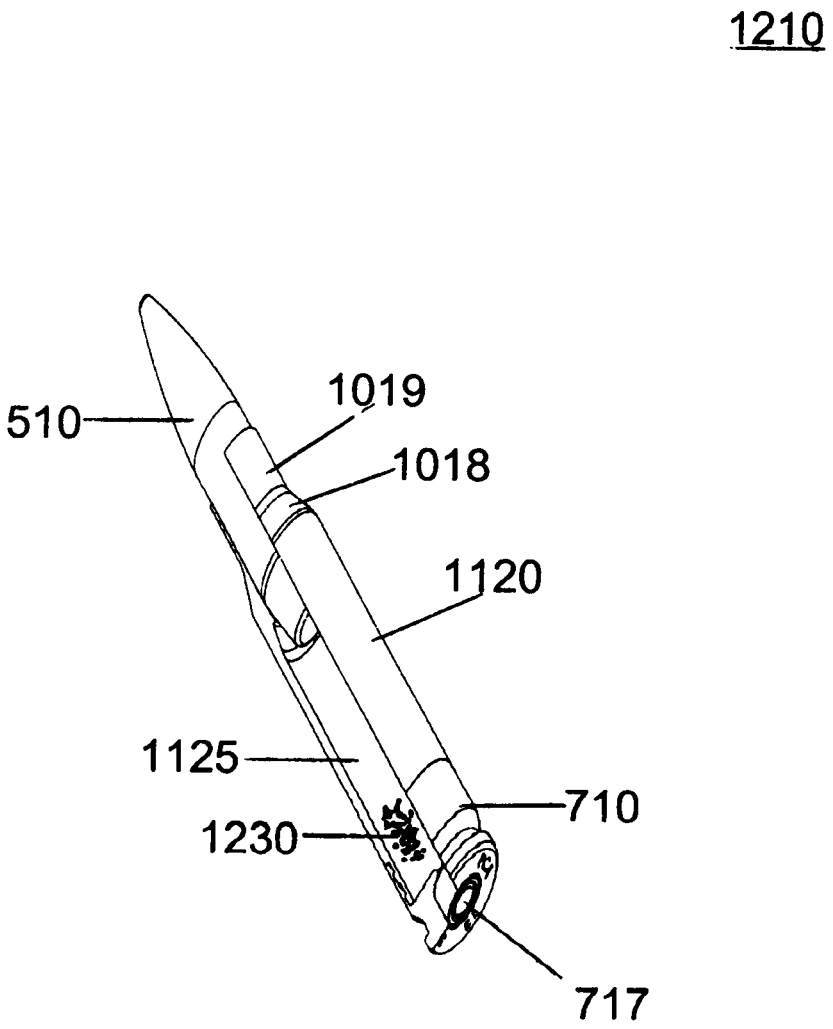
FIG. 12 depicts a supersonic PCA article made with the FIG. 11 casing according to one or more embodiments disclosed herein.

FIGS. 10 through 12 illustrate supersonic PCA article 1210 from an associated mold 1050 according to one or more embodiments made according to the one or more methods 100. FIG. 10 illustrates an open mold 1050 with a projectile seat 1015 and a cavity profile of the casing outer dimensions ("mold cavity") 1017. A projectile 510 is positioned in the projectile seat 1015 and a core pull 1016 is inserted in the mold and seated against the textured trailing end 540 of the projectile 510. Polymer is injected through one or more gates in the mold and flows in the mold cavity 1017 around the core pull forming the cavity and around the projectile trailing end forming the shoulder 1018 and neck 1019. FIG. 11 illustrates casing 1120 molded in FIG. 10 which reveals the cavity 1125 when the core pull 1016 is removed. FIG. 12 illustrates casing 1120 with the propellant charge 1230 loaded in the cavity 1125 and a primed base cap 710 attached to the casing trailing end; thereby, completing the supersonic PCA article 1210.

Figure 13:
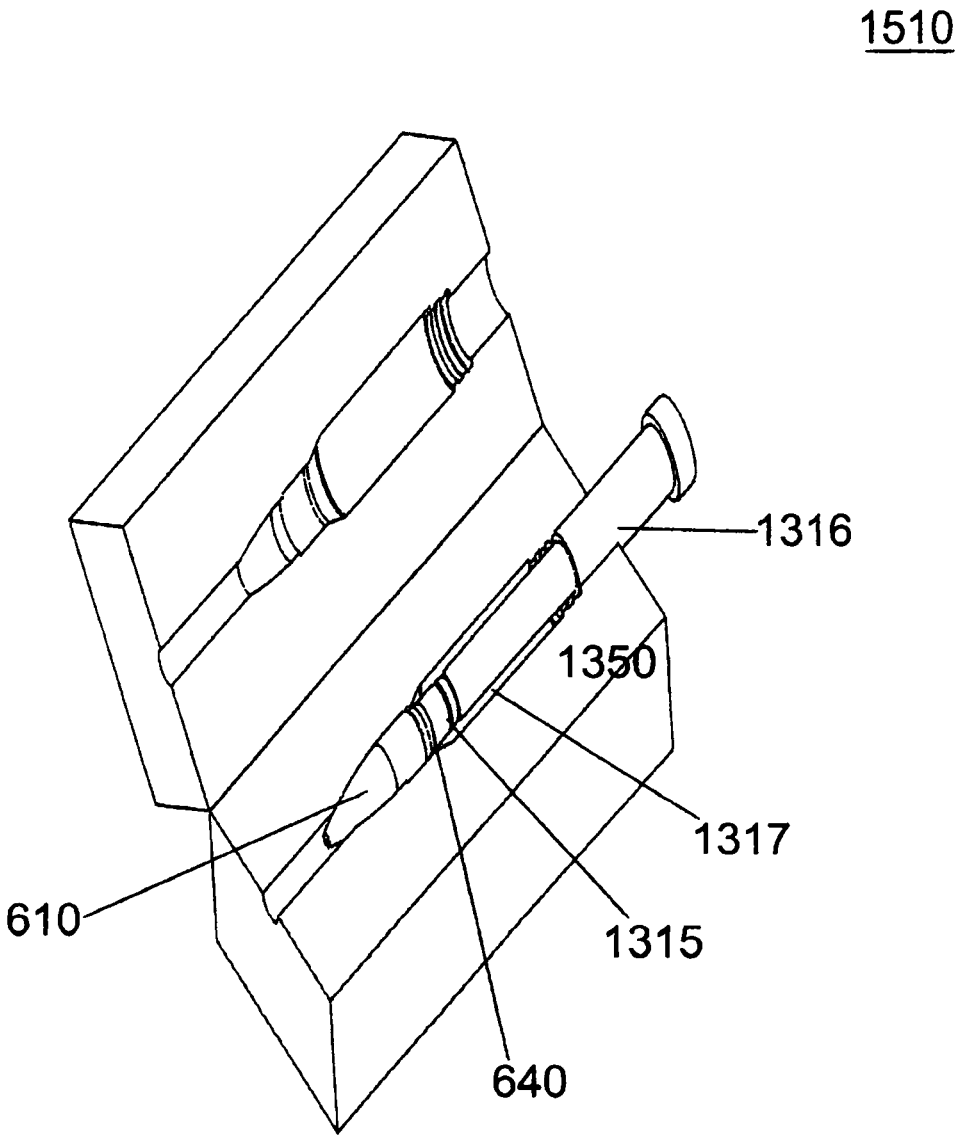
FIG. 13 depicts a FIG. 6 projectile and a core pull inserted in a mold apparatus for making a subsonic casing according to one or more embodiments disclosed herein.
Figure 14:
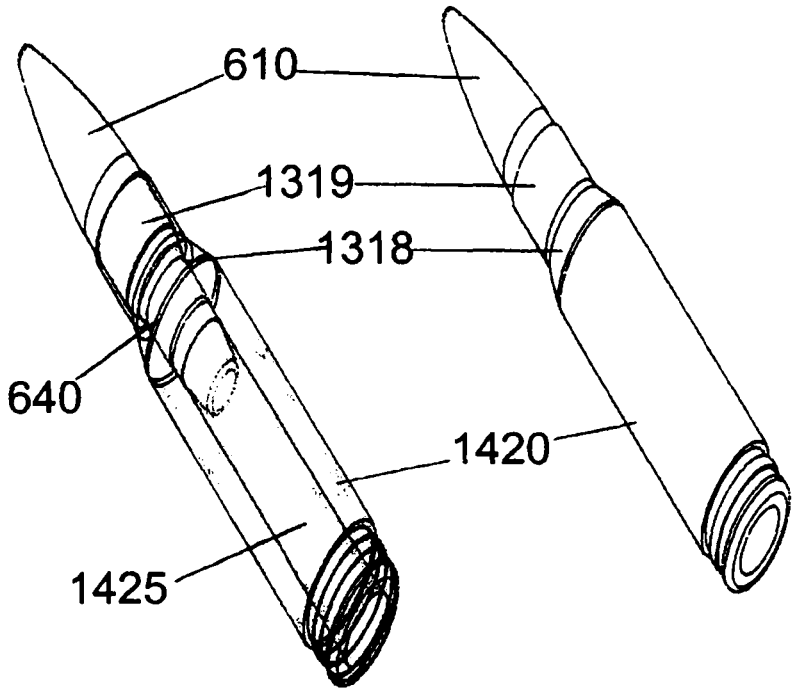
FIG. 14 depicts a casing made in FIG. 13 according to one or more embodiments disclosed herein.
Figure 15:
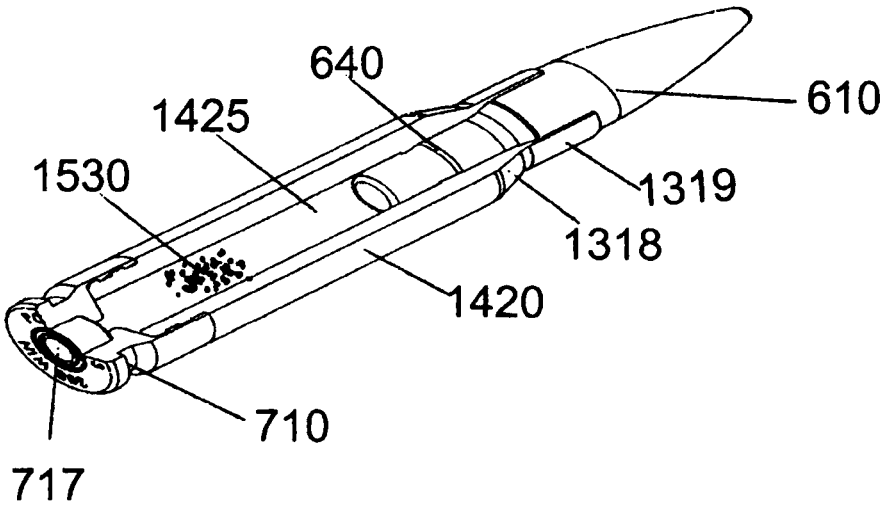
FIG. 15 depicts a subsonic PCA article made with a FIG. 14 casing according to one or more embodiments disclosed herein.

FIGS. 13 through 15 illustrate subsonic PCA article 1510 from an associated mold 1350 according to one or more embodiments made according to the one or more methods 100. FIG. 13 illustrates an open mold 1350 with a projectile seat 1315 and mold cavity 1317. A projectile 610 is positioned in the projectile seat 1315 and a core pull 1316 is inserted in the mold and seated against the textured trailing end 640 of the projectile 610. Polymer is injected through one or more gates in the mold and flows in the mold cavity 1317 around core pull 1316 forming the cavity and around the projectile trailing end, forming the shoulder 1318 and neck 1319. FIG. 14 illustrates a subsonic casing 1420 molded in FIG. 13 which reveals the cavity 1425 when the core pull is removed. FIG. 15 illustrates casing 1420 with a propellant charge 1530 loaded in the cavity 1425 and a primed base cap 710 attached to the casing trailing end with a primer 717 inserted in the primer cavity 716; thereby, completing subsonic PCA article 1510 with a smaller cavity and propellant charge but a thicker cavity wall.

Figure 16:
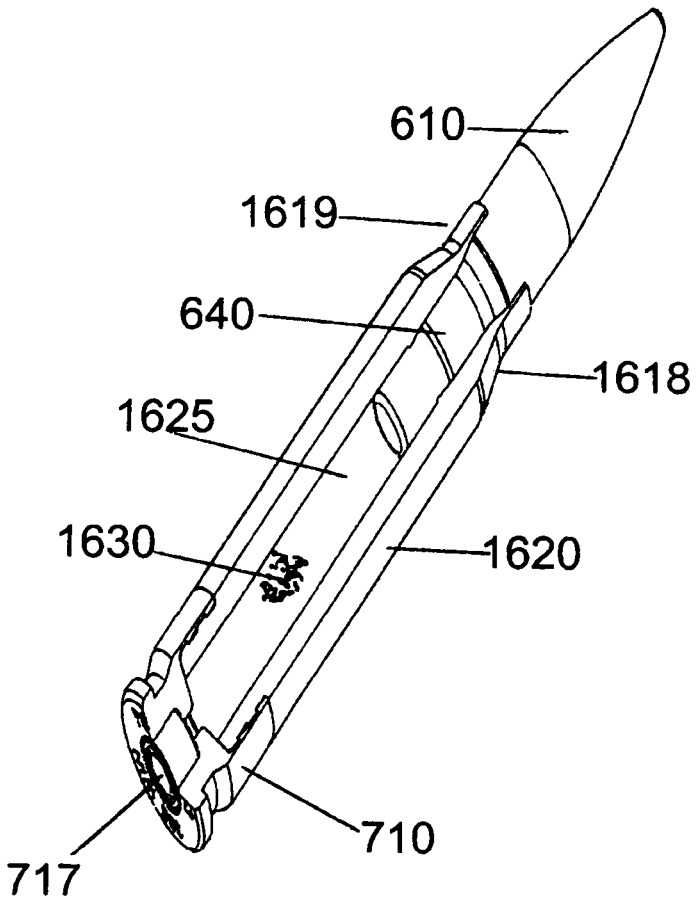
FIG. 16 depicts a supersonic PCA article of FIG. 12 or a subsonic PCA article of FIG. 15 with a short neck casing according to one or more embodiments disclosed herein.

FIG. 16 illustrates subsonic PCA article 1610 which is the same as PCA article 1510 except the casing neck 1619 is short because the polymer projectile seat 1615 provides the necessary pull tension and projectile stability.

Figure 17:
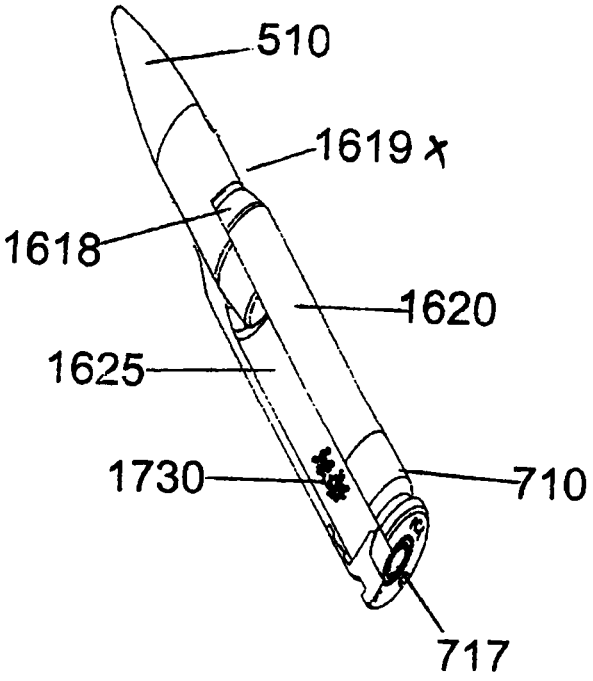
FIG. 17 depicts a supersonic PCA article of FIG. 12 or a subsonic PCA article of FIG. 15 with no neck according to one or more embodiments disclosed herein.

FIG. 17 illustrates subsonic PCA article 1710 which is the same as PCA article 1510 except the casing 1720 has no neck the projectile 510 or 610 being held by the shoulder and cavity casing.

Figure 18:
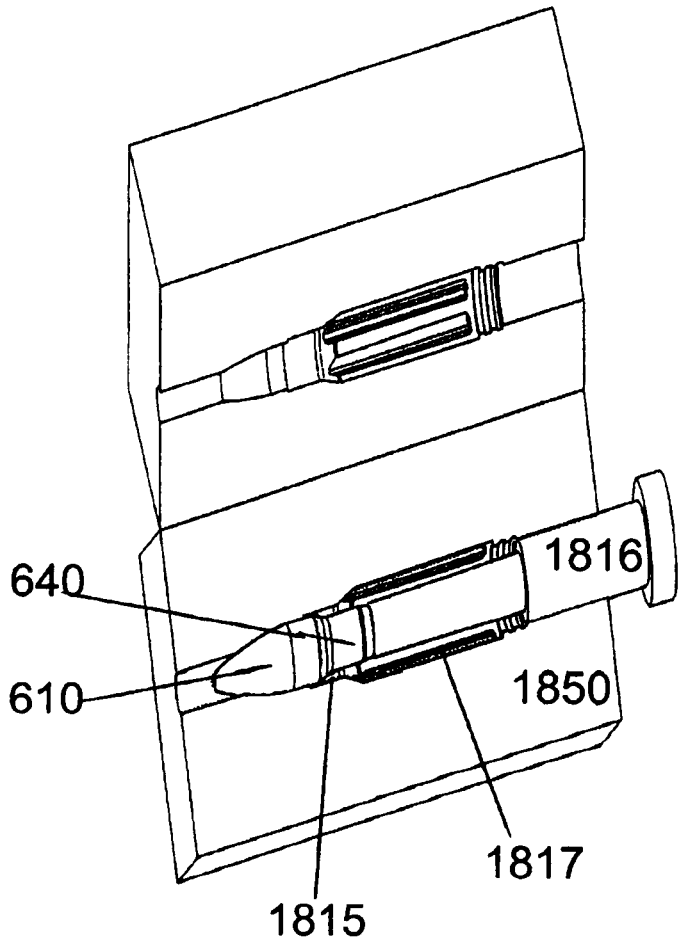
FIG. 18 depicts a FIG. 6 projectile and a core pull inserted in a mold apparatus for making a subsonic casing with external ribs according to one or more embodiments disclosed herein.
Figure 19:
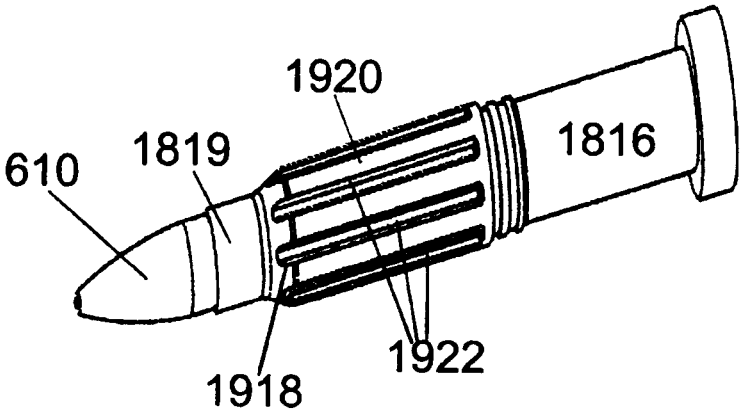
FIG. 19 depicts a casing made in a FIG. 18 mold according to one or more embodiments disclosed herein.
Figure 20:
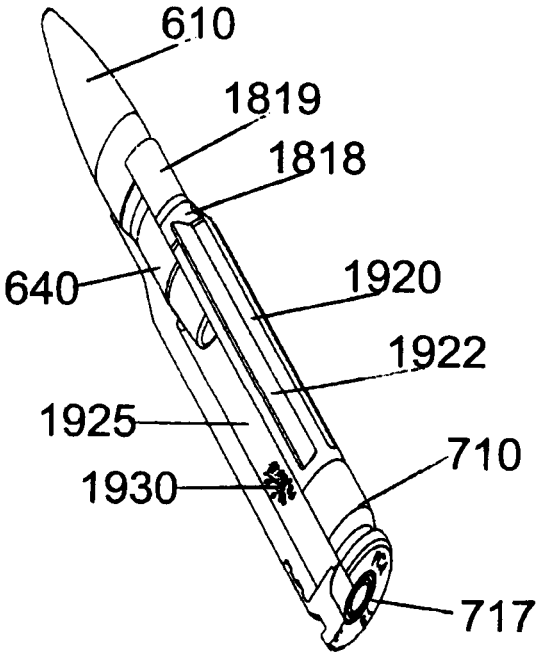
FIG. 20 depicts a subsonic PCA article made with a FIG. 19 ribbed casing according to one or more embodiments disclosed herein.

FIGS. 18 through 20 illustrate subsonic PCA article 2010 with external ribs from an associated mold 1850 according to one or more embodiments made according to the one or more methods 100. FIG. 18 illustrates an open mold 1850 with a projectile seat 1815 and a mold cavity 1817 that reveals the casing outer dimensions including external longitudinal ribs. Projectile 610 is positioned in the projectile seat 1815 and a core pull 1816 is inserted in the mold and seated against the textured projectile trailing end 640. Polymer is injected through one or more gates in the mold and flows in the mold cavity 1817 around the core pull forming the cavity 1925 and around the projectile tapered trailing end forming the shoulder 1818 and neck 1819 and ribs 1925. FIG. 19 illustrates a subsonic casing 1920 that was molded in FIG. 18 which reveals the cavity 1925 when the core pull is removed. FIG. 20 illustrates a subsonic casing 1920 with a propellant charge 2030 loaded in the cavity 1925 and a primed base cap 710 attached to the trailing end; thereby, completing subsonic PCA article 2010 with external ribs, thicker neck and cavity walls and a smaller cavity and propellant charge. The ribs will lighten the casing while strengthening the casing.

Figure 21:
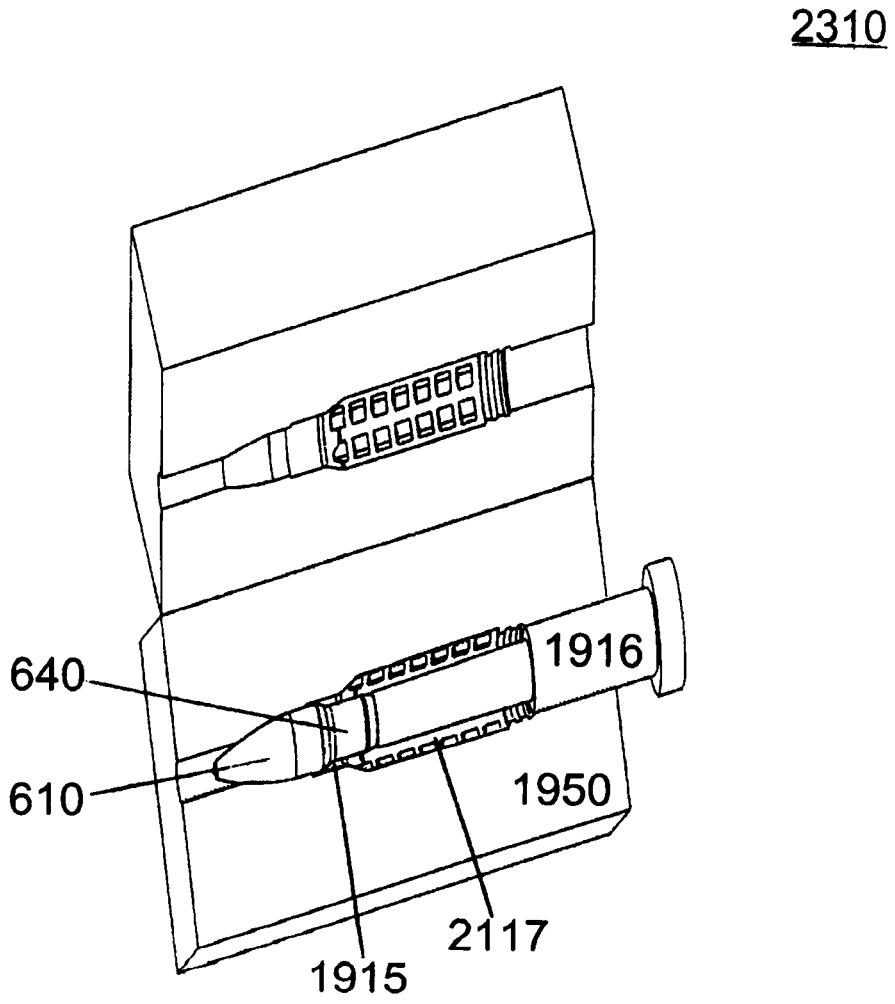
FIG. 21 depicts a FIG. 6 projectile and a core pull inserted in a mold apparatus for making a subsonic casing with external ribs and collars according to one or more embodiments disclosed herein.
Figure 22:
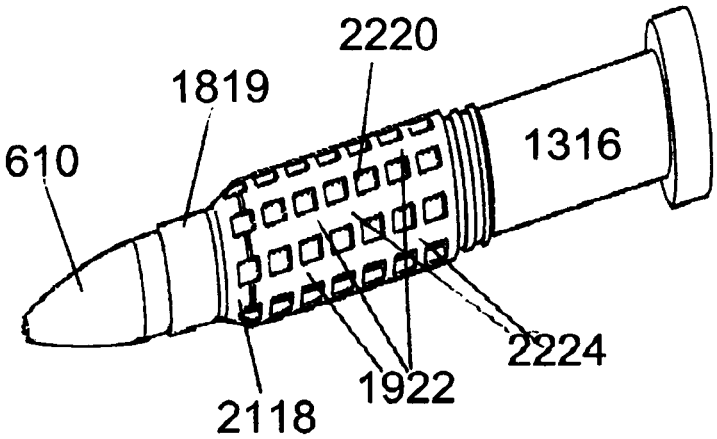
FIG. 22 depicts a casing made in a FIG. 21 mold according to one or more embodiments disclosed herein.
Figure 23:
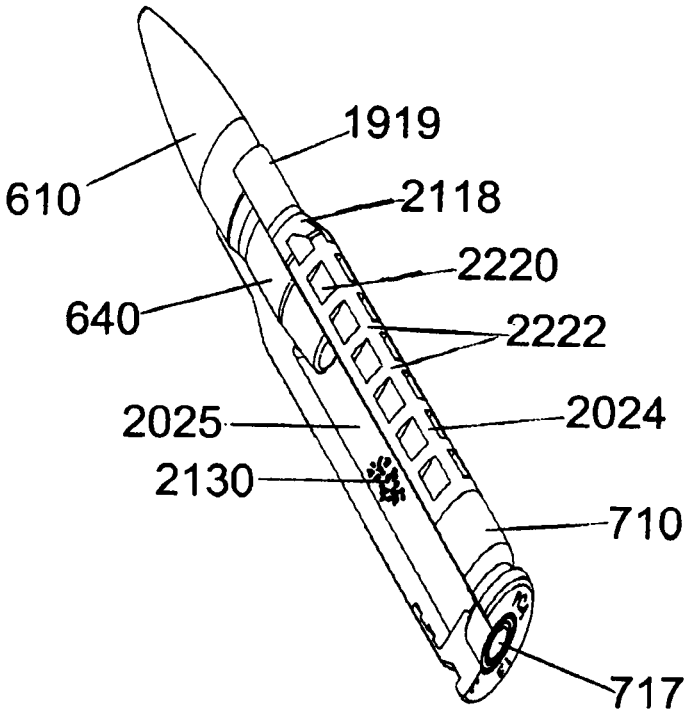
FIG. 23 depicts a subsonic PCA article made with a FIG. 22 ribbed and collared casing according to one or more embodiments disclosed herein.

FIGS. 21 through 23 illustrate a modified design of FIG. 20 which adds collars around the casing for strength. FIG. 21 Illustrates article 2310 that would be molded in 2150 with a mold cavity 2117 profile showing ribs 1922 and collars 2224. FIG. 22 is cavity molded in FIG. 22 and FIG. 23 is a subsonic article with external ribs and collars assembled in the same as 2010.

Figure 24:
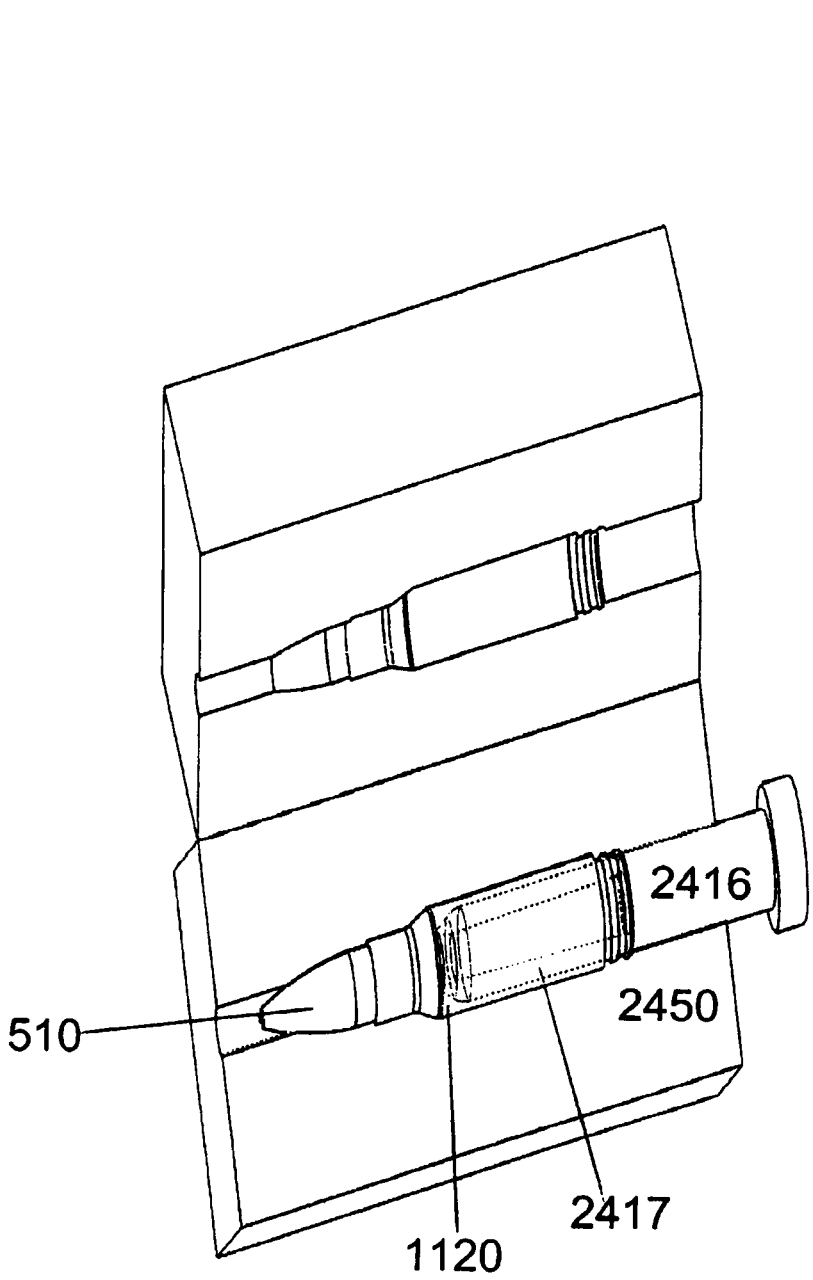
FIG. 24 depicts a mold apparatus with a core pull inserted therein for making a supersonic cavity sleeve ("cavity sleeve") according to one or more embodiments disclosed herein.
Figure 25:
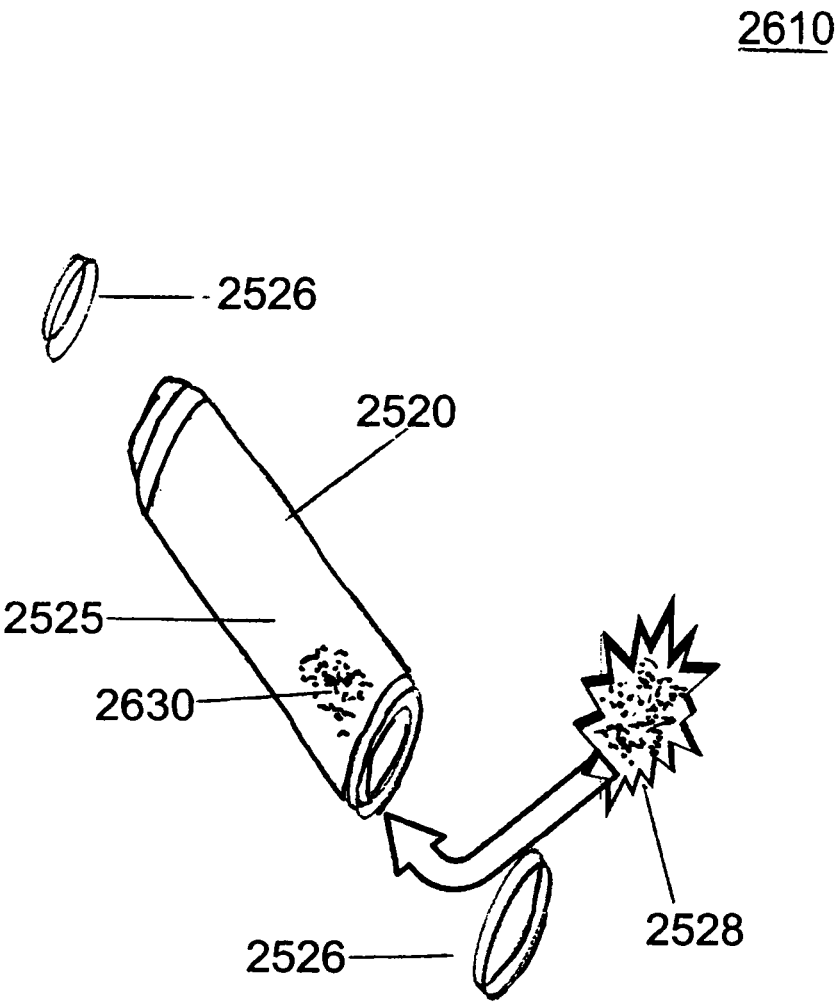
FIG. 25 depicts a cavity sleeve made in FIG. 24 and according to one or more embodiments disclosed herein.
Figure 26:
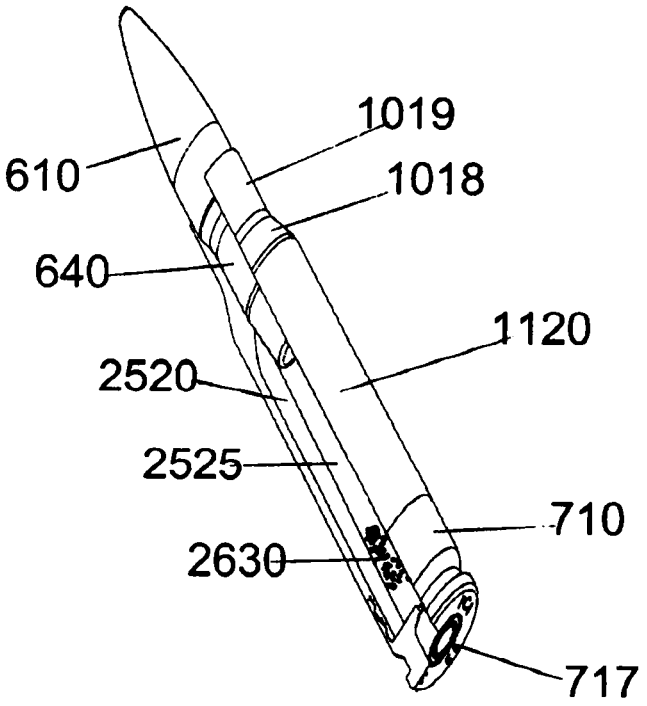
FIG. 26 depicts a subsonic PCA article converted from a supersonic casing by use of the FIG. 25 cavity sleeve according to one or more embodiments disclosed herein.

FIGS. 24 through 26 illustrate a cavity sleeve 2520 from an associated mold 2450 according to one or more embodiments made according to the one or more methods 200. FIG. 24 illustrates an open mold 2450 tooled to mold cavity sleeves sized to fit in the cavity of supersonic casing 1120. Core pull 2416 is inserted in mold 2450 and polymer is injected through one or more gates in the mold and flows in the mold cavity 2417 around the core pull forming cavity sleeve 2520. FIG. 23 illustrates the cavity sleeve 2520 which reveals a subsonic cavity 2525. Furthermore, FIG. 26 illustrates a supersonic casing 1120 with a sleeve 2520 inserted therein; thereby, converting supersonic casing 1120 into a subsonic casing 2610. FIG. 24 illustrates a converted casing 1120 with a subsonic propellant charge 2630 loaded in cavity 2525 and a primed base cap 710 attached to the casing trailing end, thereby completing the conversion of supersonic casing 1120 to subsonic PCA article 2610 with a thicker cavity wall and a smaller cavity and propellant charge.

Figure 27:
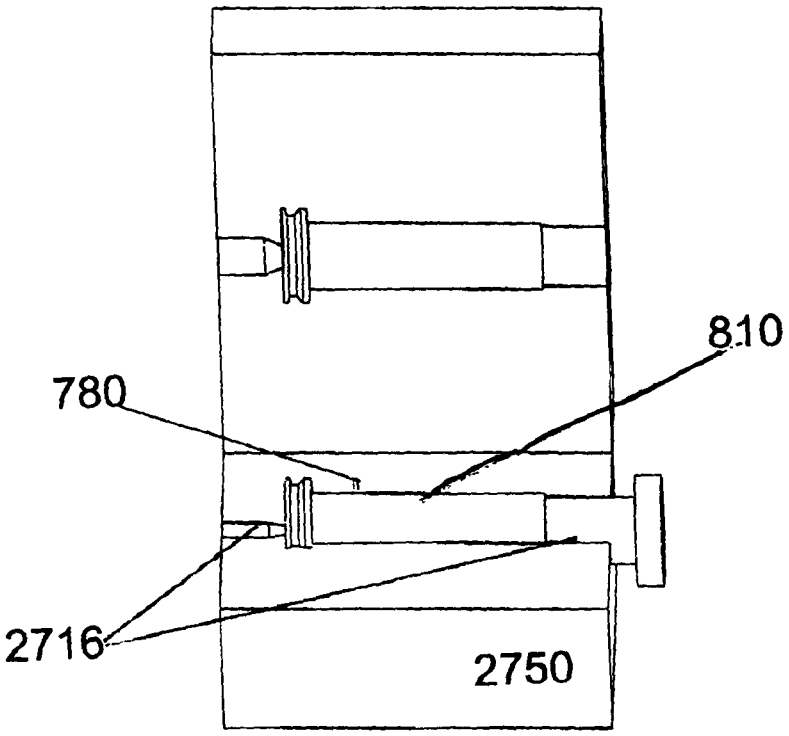
FIG. 27 depicts a FIG. 8 core sleeve and a core pull inserted in a mold apparatus for making a subsonic PCA casing according to one or more embodiments disclosed herein.
Figure 28:
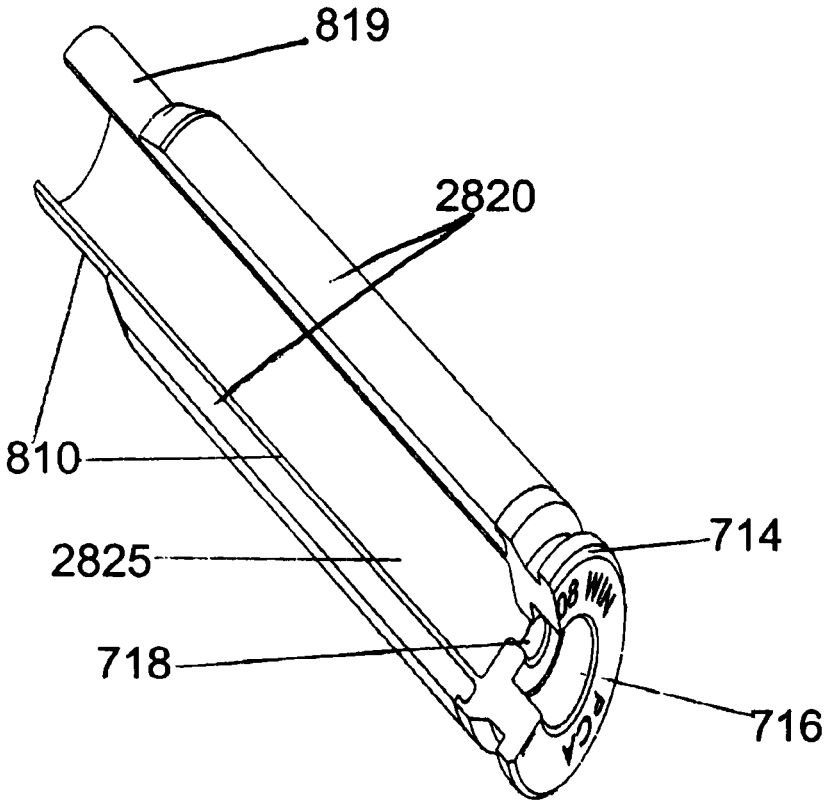
FIG. 28 depicts a subsonic PCA casing made in FIG. 27 over a core sleeve according to one or more embodiments disclosed herein.
Figure 29:
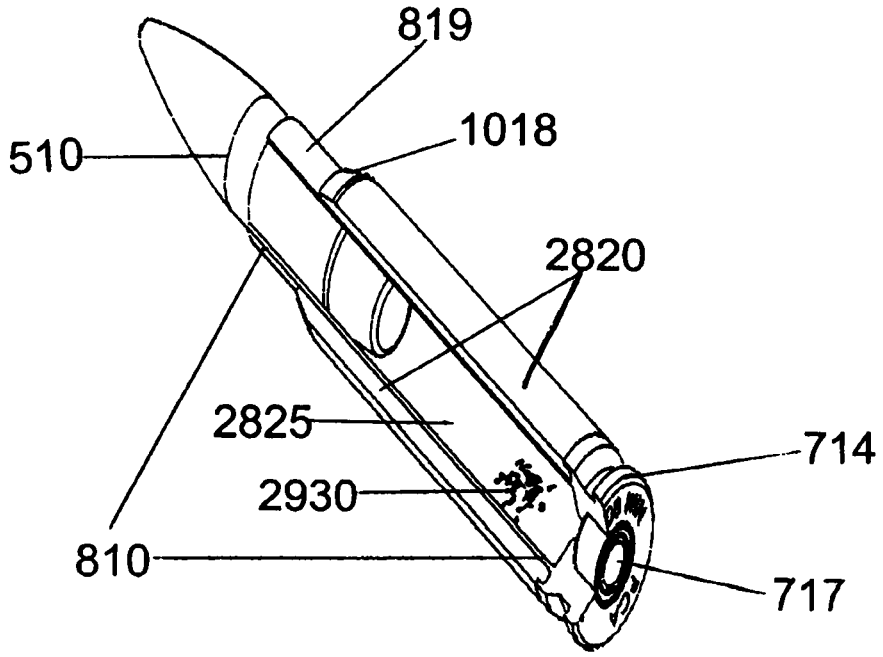
FIG. 29 depicts a subsonic PCA article made with a FIG. 27 casing according to one or more embodiments disclosed herein.

FIGS. 27 through 29 illustrate subsonic PCA article 2910 from an associated mold 2750 according to one or more embodiments made according to the one or more methods 300. FIG. 27 illustrates an open mold apparatus 2750 with a core sleeve 810 inserted in the mold and a subsonic core pull 2716 inserted through the neck of the core sleeve 810 and seated against the base thereof. The base of the core sleeve 815 contains features of a base cap 710. Polymer is injected through one or more gates in the mold and flows in the cavity around the core sleeve forming the casing 2820. FIG. 28 illustrates casing 2820 when the core pull is removed with the core sleeve remaining within the casing 2820. FIG. 29 illustrates casing 2620 with a subsonic polymer charge 2930 loaded in the cavity 2680 through the neck and projectile 510 inserted in the neck using one of several methods to create neck tension; thereby, completing the conversion of supersonic PCA casing 1120 to subsonic article 2910 with a metal neck, a thicker cavity wall and a smaller cavity and propellant charge.

Figure 30:
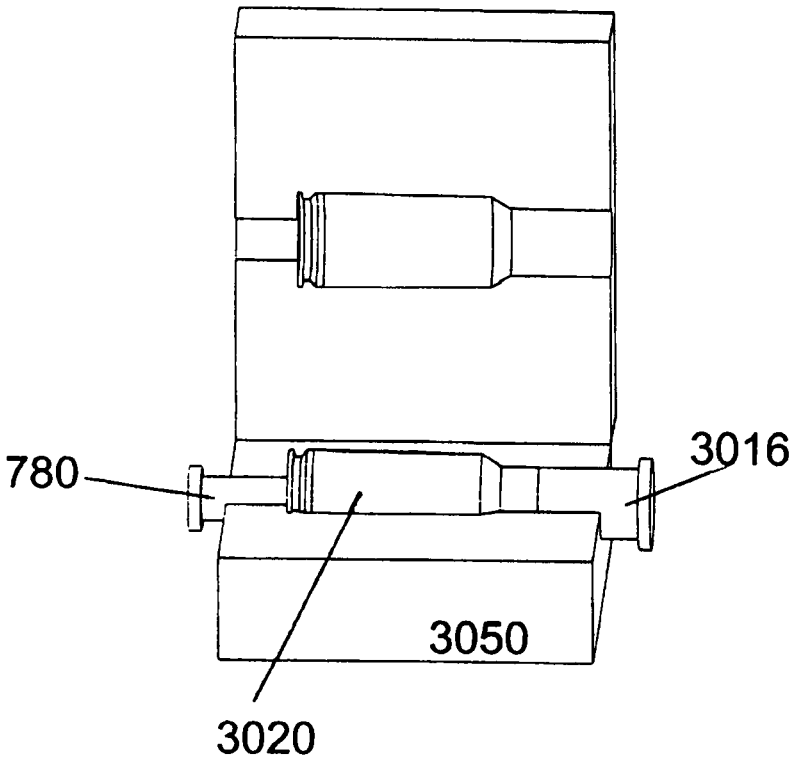
FIG. 30 depicts a rigid casing and core pull inserted in a mold apparatus for inserting a polymer sleeve in a rigid casing according to one or more embodiments disclosed herein.
Figure 31:
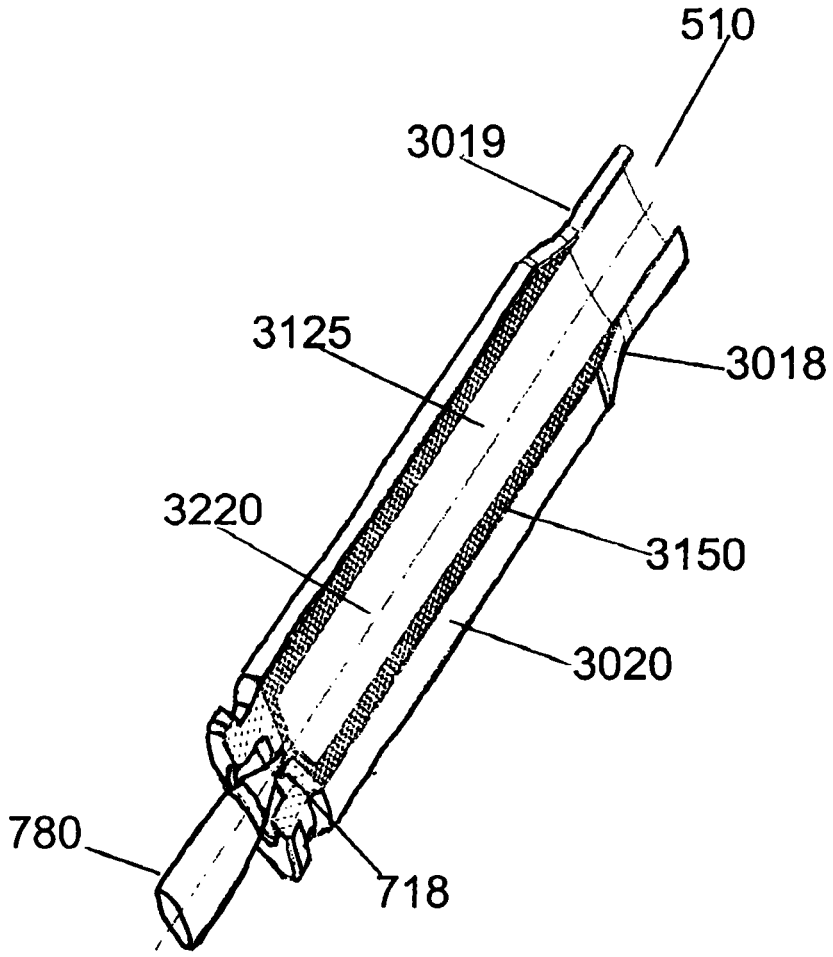
FIG. 31 depicts a rigid supersonic casing converted to subsonic in FIG. 30 according to one or more embodiments disclosed herein.
Figure 32:
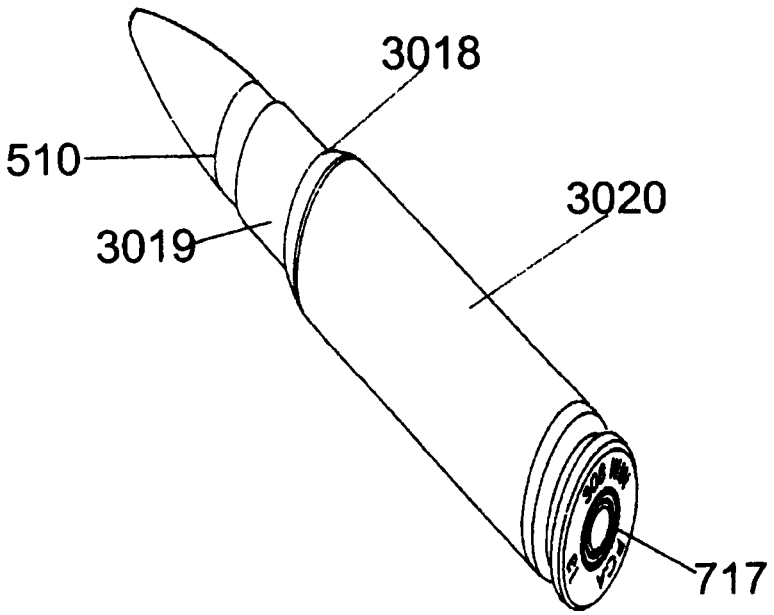
FIG. 32 depicts a subsonic rigid cased article primed, loaded and with a Projectile inserted according to one or more embodiments disclosed herein.

FIGS. 30 through 32 illustrate converting a rigid case supersonic ammunition article such as brass to a subsonic ammunition article 3210 by injection molding a polymer sleeve in the casing, increasing the casing wall thickness and reducing the cavity to correspond to the propellant charge volume. FIG. 30 illustrates an open mold apparatus 3050 in which a rigid casing 3020 and a core pull 3016 have been inserted. Although injection molding through one or more gates in the core pull or through the side of the casing are possible, this illustration demonstrates preferred positioning the gate 780 in the primer cavity 716 and injecting polymer through the flash-hole 718. The core pull is injected through the neck of the casing creating the mold cavity in to which the polymer sleeve is injected. FIG. 31 illustrates the casing with a sleeve inserted and revealing subsonic cavity when the core pull is removed that is tuned to the desired propellant charge. FIG. 32 illustrates a cross section view of a rigid cased polymer sleeved subsonic ammunition article that is primed, charged and with the projectile inserted.

As used herein, the one or more molds and methods for making an ammunition article may be carried out at first and second stations. The first station may be provided for forming the casing, and the second station may be provided for injection molding around a core pull within the casing according to any of the embodiments disclosed herein.

The one or more ammunition articles disclosed herein may have various advantages over conventional ammunition articles. As described, the ability to form a case cavity volume equal to the desired propellant charge propellant charge volume for a specified caliber and projectile is beneficial to achieve consistent desired ballistics. Additionally, the gap of unfilled area in the casing associated with, for example, conventional subsonic ammunition articles is reduced or eliminated. Furthermore, the casing strength may be increased due to the thickness of the sidewall and polymer cased ammunition articles will be lighter weight than metal articles of the same characteristics.

What is claimed:

1. A method of making an ammunition article, comprising:
providing a cartridge casing;
providing a projectile for being engaged with the cartridge casing;
determining a desired propellant charge to achieve one or more characteristic, the one or more characteristic including a desired functional characteristics for the article;
selecting a core pull having at least one dimension corresponding to the dimension of a desired propellant charge volume corresponding to the desired functional characteristics for the article;
placing the cartridge casing in a mold;
inserting the core pull into the cartridge casing; and
injection molding, in a mold, a material within an interior circumference of the cartridge casing and around the core pull to form a polymer liner that defines a casing volume for the propellant charge volume after the core pull is removed.

2. The method of claim 1 wherein:
a primer is inserted in a primer cavity at a trailing end of the casing;
a propellant charge is loaded in the cavity through a neck end of the cartridge casing; and
the method further includes inserting the projectile into the neck end.

3. The method of claim 1, wherein the cartridge casing is a rigid casing having a base cap with a primer cavity, a flash hole, and an ejector ring.

4. The method of claim 3, wherein the cartridge casing is a metal casing.

5. The method of claim 3, wherein injection molding comprises injection molding through a gate positioned in the flash hole.

6. The method of claim 3, wherein a primer is inserted in the primer cavity, the propellant is inserted in the propellant cavity and the projectile is attached to a neck end of the cartridge casing.

7. The method of claim 3, wherein injection molding comprises injection molding through one or more gates that are defined in the core pull.

8. The method of claim 1, wherein injection molding comprises injection molding around a portion of the projectile, wherein the projectile is received in the cartridge casing during injection molding.

9. The method of claim 1, wherein injection molding comprises injection molding between the core pull and the cartridge casing toward the neck end of the cartridge casing, thereby forming a projectile seat.

10. The method of claim 1, wherein the polymer liner extends from about the base cap to about the projectile.

11. The method of claim 1, wherein the polymer liner extends along a length of an inner facing portion of the cartridge casing.

12. The method of claim 1, wherein the polymer liner extends along a length of an inner facing portion of the cartridge casing to a portion of the cartridge casing where the projectile is seated.

13. The method of claim 1, wherein determining a desired propellant charge to achieve one or more characteristics comprises determining a desired propellant charge that corresponds to a subsonic charge for the projectile.

14. The method of claim 1, wherein the ammunition article is a subsonic ammunition article.

15. A subsonic ammunition article having a cartridge casing and an interior polymer liner that forms a desired cartridge volume for containing propellant charge, the ammunition article made according to the process of:
providing the cartridge casing;
providing a projectile for being engaged with the cartridge casing;
determining a desired propellant charge to achieve one or more characteristic, the one or more characteristics including a desired functional characteristics for the article;
selecting a core pull having at least one dimension corresponding to the dimension of the desired propellant charge volume corresponding to the desired functional characteristics for the article, wherein the desired functional characteristic is a subsonic charge volume for the projectile;
placing the cartridge casing in a mold;
inserting the core pull into the cartridge casing; and
injection molding, in a mold, a material within an interior circumference of the cartridge casing and around the core pull to form the polymer liner that defines the desired casing volume for the propellant charge volume after the core pull is removed.

* * * * *